US006410139B1

(12) United States Patent
Tsutsui et al.

(10) Patent No.: US 6,410,139 B1
(45) Date of Patent: Jun. 25, 2002

(54) SPLIT TYPE CONJUGATE FIBER, METHOD FOR PRODUCING THE SAME AND FIBER FORMED ARTICLE USING THE SAME

(75) Inventors: Toshihiko Tsutsui; Mitsuru Kojima; Masayasu Suzuki; Kazuyuki Sakamoto; Masaru Nishijima, all of Shiga (JP)

(73) Assignee: Chisso Corporation, Osaka (JP)

( * ) Notice: Subject to any disclaimer, the term of this patent is extended or adjusted under 35 U.S.C. 154(b) by 0 days.

(21) Appl. No.: 09/674,384

(22) PCT Filed: Feb. 29, 2000

(86) PCT No.: PCT/JP00/01180

§ 371 (c)(1),
(2), (4) Date: Oct. 31, 2000

(87) PCT Pub. No.: WO00/53831

PCT Pub. Date: Sep. 14, 2000

(30) Foreign Application Priority Data

| | | |
|---|---|---|
| Mar. 8, 1999 | (JP) | 11-060134 |
| Mar. 11, 1999 | (JP) | 11-065180 |
| Mar. 17, 1999 | (JP) | 11-072583 |
| Jun. 11, 1999 | (JP) | 11-164851 |
| Jul. 19, 1999 | (JP) | 11-204851 |
| Dec. 24, 1999 | (JP) | 11-367309 |

(51) Int. Cl.[7] ..... D01F 8/00
(52) U.S. Cl. ..... 428/373; 428/374; 428/370
(58) Field of Search ..... 428/370, 373, 428/374

(56) References Cited

U.S. PATENT DOCUMENTS 5,965,084 A 10/1999 Nishijima ..... 264/557

FOREIGN PATENT DOCUMENTS

| | | |
|---|---|---|
| JP | 484709 | 8/1974 |
| JP | 5228918 | 7/1977 |
| JP | 5310169 | 4/1978 |
| JP | 5310170 | 4/1978 |
| JP | 5347416 | 12/1978 |
| JP | 3213555 | 9/1991 |
| JP | 4119112 | 4/1992 |
| JP | 4289222 | 10/1992 |
| JP | 5025762 | 2/1993 |
| JP | 5239717 | 9/1993 |
| JP | 663129 | 8/1994 |
| JP | 8311718 | 11/1996 |
| JP | 8325827 | 12/1996 |

*Primary Examiner*—N. Edwards
(74) *Attorney, Agent, or Firm*—Fay, Sharpe, Fagan, Minnich & McKee, LLP

(57) ABSTRACT

The invention is directed to a split conjugated fiber.

6 Claims, 10 Drawing Sheets

SPLIT TYPE CONJUGATE FIBER, METHOD FOR PRODUCING THE SAME AND FIBER FORMED ARTICLE USING THE SAME

TECHNICAL FIELD

The present invention relates to a splittable multi-component fiber of good splittability, a method for producing it, and a fibrous article comprising it. More precisely, the invention relates to a splittable multi-component fiber of good splittability favorable for use in the field of industrial materials for battery separators, wipers, filters, etc., and also in the field of sanitary materials for napkin, etc., and relates to a method for producing it, and a fibrous article comprising it.

BACKGROUND ART

Heretofore known is a method of using sea-island or splittable multi-component fibers for producing fine fibers. In the method of using sea-island multi-component fibers, a plurality of different components are combined and spun into multi-component fibers, and one component of the resulting multi-component fibers is dissolved and removed to give fine fibers. The method gives extremely fine fibers, but is uneconomical as requiring the step of dissolving and removing one component of the multi-component fibers. In the other method of using splittable multi-component fibers, a plurality of different resins are combined and spun into multi-component fibers, and the resulting multi-component fibers are split into a large number of fine fibers by applying physical stress to them or by processing them with a chemical reagent with which the resins constituting each fiber shrink to different degrees. Known are various types of multi-component fibers made from a plurality of different resins, including, for example, a combination of a polyester resin and a polyolefin resin, a combination of a polyester resin and a polyamide resin, a; combination of a polyamide resin and a polyolefin resin, etc. However, in the process of splitting the splittable multi-component fibers into fine fibers followed by further processing the resulting fine fibers to give non-woven fabrics and others, the step of splitting the multi-component fibers into fine fibers by processing them with high-pressure liquid jets takes a lot of time, and this is the rate-determining step for the subsequent step of processing the resulting fine fibers to give non-woven fabrics. In addition, the energy cost for the step of splitt ing the multi-component fibers into fine fibers is high. Moreover, the thus split fine fibers and fibrous articles comprising them inevitably contain different types of polymers, and, at present, their applications in the field of industrial materials that are required to be resistant to chemicals are limited.

On the other hand, in splittable multi-component fibers from a combination of a plurality of resins of the same type, for example, from a combination of polyolefin resins, that of polyester resins, or that of polyamide resins or the like, the constituent polymers are more highly miscible with each other, as compared with those in splittable multi-component fibers from a combination of a plurality of different types of resins such as that mentioned above. Therefore, the multi-component fibers of the former type need greater physical impact for splitting them into fine fibers. As a result, the multi-component fibers thus having received such greater physical impact will be split into uneven fibers, some of which are thick but some others are thin. Such uneven fibers are problematic in that non-woven fabrics made from them have a bad uniformity, and the line speed for processing them with high-pressure liquid jets must be significantly lowered. To that effect, the multi-component fibers are problematic and are not satisfactory.

To solve the problem, Japanese Patent Laid-Open No. 28922/1992 discloses a splittable multi-component fiber comprising a plurality of resins of the same type to which is added an organosiloxane or a modified organosiloxane. They say therein that the splittable multi-component fiber, though comprising polymers of the same type, can be readily split into fine fibers. The splittability of the multi-component fiber disclosed could be enhanced in some degree, but the fiber is still problematic in that the strength of fibrous articles (non-woven fabrics, etc.) comprising the split fibers is low and that the secondary workability of the fibrous articles is poor.

DISCLOSURE OF THE INVENTION

We, the present inventors have assiduously studied so as to obtain splittable multi-component fibers free from the prior art problems noted above, and to obtain uniform fibrous articles comprising them. As a result, we have found that a splittable multi-component fiber comprising at least two thermoplastic resin components, in which one thermoplastic resin component is broken to form a partially conjugated part having been broken in the direction of the fiber axis (see FIG. 2) and/or a non-conjugated part (see FIG. 3) around the multi-component fiber, is readily splittable, and that a fibrous article comprising the splittable multi-component fibers has uniformity. We have also found that a splittable multi-component fiber comprising at least two polyolefin resin components and having a hollow with the individual constituent resin components being alternately radially aligned around the hollow in its cross section and with the percentage of its hollowness falling between 5 and 40%—in which the ratio of the mean length, W, of the outer peripheral arc of one constituent resin component to the mean thickness, L, of the component between the end of the hollow and the outer periphery of the fiber, W/L, falls between 0.25 and 2.5—is readily splittable, and that a fibrous article comprising the splittable multi-component fibers has fineness and uniformity. We have still found that a splittable multi-component fiber comprising at least two thermoplastic resin components—in which the constituent components are alternately aligned to be adjacent to each other in the direction of the fiber axis in the cross section of the fiber, the cross section is bent, curved or flattened, and the ratio of the major axis, L, of the cross section to the minor axis, W, thereof , L/W falls between 3 and 20—is readily splittable, and that a fibrous article and a piled fibrous article comprising the splittable multi-component fibers has fineness and uniformity. We have still found that a splittable multi-component fiber comprising at least two thermoplastic resin components—in which the constituent components are alternately aligned to be adjacent to each other in the direction of the fiber axis in the cross section of the fiber, the cross section is bent, curved or flattened, and the ratio of the major axis, L, of the cross section to the minor axis, W, thereof, L/W falls between 3 and 20—is readily splittable, and that a fibrous article and a laminated fibrous article comprising the splittable multi-component fibers has fineness and uniformity. On the basis of these findings, we have completed the present invention. As is obvious from the above-mentioned description, the object of the invention is to provide a splittable multi-component fiber capable of being readily split into fine fibers, a method for producing it, a fibrous article having uniformity that comprises the fiber, and a product comprising the article.

The invention is composed of a first aspect including the following (1) to (6), a second aspect including the following (7) to (21), a third aspect including the following (22) to (28), and a fourth aspect including the following (29) to (43).

(1). A splittable multi-component fiber comprising thermoplastic resin components (A) and (B) alternately aligned in its cross section, which is characterized in that the component (A) is formed continuously in the direction of the fiber axis, and the component (B) is so randomly formed that some of it is conjugated to the component (A) in the direction of the fiber axis to give a completely conjugated part and some others of it are broken in the direction of the fiber axis to give a partially conjugated part in which the area conjugated to the component (A) is smaller than that in the completely conjugated part and/or a non-conjugated part in which the component (B) is deleted in the direction of the fiber axis and is not conjugated to the component (A).

(2) The splittable multi-component fiber of above (1) wherein the component (B) is a low-density polyethylene resin, the component (A) is a thermoplastic resin except the low-density polyethylene, and the two components (A) and (B) are alternately radially aligned in the cross section of the fiber to have an alternate radial cross-section profile.

(3) The splittable multi-component fiber of any one of above (1) or (2), wherein the component (A) is a polypropylene resin and the component (B) is a low-density polyethylene resin.

(4) The splittable multi-component fiber of any one of above (1) to (3), which has a hollow cross-section profile.

(5) The splittable multi-component fiber of any one of above (1) to (4), which has a cross-section profile of irregular shape.

(6) A fibrous article comprising the splittable multi-component fibers of any one of above (1) to (5).

(7) A splittable multi-component fiber comprising at least two thermoplastic resin components, which is characterized in that the constituent components are alternately aligned to be adjacent to each other in the direction of the fiber axis in the cross section of the fiber, the cross section is bent, curved or flattened, and the ratio of the major axis, L, of the cross section to the minor axis, W, thereof, L/W falls between 3 and 20.

(8) The splittable multi-component fiber of above (7), wherein the ratio of the outer peripheral length, a, of one constituent component to the contact length, b, thereof neighboring to the adjacent component, a/b, in the cross section falls between 0.1 and 2.5.

(9) The splittable multi-component fiber of any one of above (7) or (8), wherein the ratio of the area, S1, surrounded by the bent or curved constituent components in the cross section to the cross-sectional area, S2, of the fiber, S1/S2 falls between 0.2 and 1.0.

(10) The splittable multi-component fiber of any one of above (7) to L(9), wherein at least two constituent, thermoplastic resin components all have, after having formed fibers, a melt flow rate falling between 10 and 100 g/10 min, and the ratio of the melt flow rate, MFR-A, of the resin component (component A) having the highest melting point of all the constituent components to the melt flow rate, MFR-B, of the resin component (component B) having the lowest melting point of all, MFR-A/MFR-B falls between 0.1 and 5.

(11) The splittable multi-component fiber of any one of above (7) to (10), wherein the combination of at least two thermoplastic resin components is a combination of a polypropylene resin and a polyethylene resin.

(12) The splittable multi-component fiber of any one of above (7) to (11), which has, before being split, a single fiber fineness falling between 0.5 and 10 dtex, and gives, after having been split, fine fibers having a single fiber fineness of at most 0.5 dtex.

(13) A fibrous article containing at least 30% by weight of the splittable multi-component fibers of any one of above (7) to (12), in which at least 50% of the fibers are split.

(14) The fibrous article of above (13) which is an aggregate of fiber.

(15) The fibrous article of any one of above (13) or (14), which is an aggregate of fiber obtained by spun-bond method.

(16) A laminated fibrous article, which is formed by laminating a sheet onto one or both surfaces of the fibrous article of any one of above (13) to (15).

(17) A laminated fibrous article, which is formed by laminating the fibrous article of any one of above (13) to (15) onto both surfaces of a sheet.

(18) The laminated fibrous article of any one of above (16) or (17), wherein the sheet is at least one selected from non-woven fabrics, films, knitted fabrics and woven fabrics.

(19) An absorbent article comprising the fibrous article of any one of above (13) to (15) or the laminated fibrous article of any one of above (16) to (18).

(20) A wiper comprising the fibrous article of any one of above (13) to (15) or the laminated fibrous article of any one of above (16) to (18).

(21) A battery separator comprising the fibrous article of any one of above (13) to (15) or the laminated fibrous article of any one. of above (16) to (18).

(22) A splittable polyolefin multi-component fiber comprising at least two polyolefin resin components and having a hollow in its center, which is characterized in that the individual constituent components are alternately radially aligned around the hollow in its cross section, the percentage of its hollowness falls between 5 and 40%, and the ratio of the mean length, W, of the outer peripheral arc of one constituent resin component to the mean thickness, L, of the component between the end of the hollow and the outer periphery of the fiber, W/L, falls between 0.25 and 2.5.

(23) The splittable polyolefin multi-component fiber of above (22), wherein the cross-section profile of the hollow is so configured that it has at least one curve of which the radius of curvature ($\rho$) is smaller than the radius of the circle having the same area as the cross-sectional area of the hollow.

(24) The splittable polyolefin multi-component fiber of any one of above (22) or (23), wherein at least two constituent polyolefin resin components all have, after having formed fibers, a melt flow rate falling between 10 and 100 g/10 min, and the ratio of the melt flow rate, MFR-A, of the resin component (component A) having the highest melting point of all the constituent components to the melt flow rate, MFR-B, of the resin component (component B) having the lowest melting point of all, MFR-A/MFR-B falls between 0.1 and 5.

(25) The splittable polyolefin multi-component fiber of any one of above (22) to (24), wherein the combination of at least two polyolefin resin components is a combination of a polypropylene resin and a polyethylene resin.

(26) The splittable polyolefin multi-component fiber of any one of above (22) to (24), wherein the combination of at least two polyolefin resin components is a combination of a stereo-specific polystyrene resin and a polypropylene resin.

(27) The splittable polyolefin multi-component fiber of any one of above (22) to (26), which has, before being split, a single fiber fineness falling between 0.6 and 10 dtex, and gives, after having been split, fine fibers having a single fiber fineness of smaller than 0.6 dtex.

(28) A fibrous article containing at least 30% by weight of the splittable polyolefin multi-component fibers of any one of above (22) to (27), in which at least 50% of the fibers are split.

(29) A splittable polyolefin multi-component fiber comprising at least two polyolefin resin components and having a hollow in its center with the individual constituent components being alternately aligned around the hollow in its cross section, which is deformed by external stress to have a flattened cross-section profile to a degree of deformation (minor axis W/major axis L) falling between 0.2 and 0.9 and is so constructed that at least a part of the constituent components are peeled off.

(30) The splittable polyolefin multi-component fiber of above (29), in which the constituent components are peeled off to a degree of at least 10% of their contact interfaces in the cross section of the fiber.

(31) The splittable polyolefin multi-component fiber of any one of above (29) and (30), wherein the constituent components are alternately radially aligned in the cross section of the fiber.

(32) The splittable polyolefin multi-component fiber of any one of above (29) to (31), wherein the combination of at least two polyolefin resin components is a combination of a polypropylene resin and a polyethylene resin.

(33) The splittable polyolefin multi-component fiber of any one of above (29) to (32), which has, before being split, a single fiber fineness falling between 0.6 and 10 dtex, and gives, after having been split, fine fibers having a single fiber fineness of smaller than 0.6 dtex.

(34) A fibrous article containing at least 30% by weight of the splittable multi-component fibers of any one of above (29) to (33), in which at least 50% by weight of the fibers are split.

(35) The fibrous article of above (34), which is an aggregate of fiber.

(36) The fibrous article of any one of above (34) or (35), which is an aggregate of fiber obtained by spun-bond method.

(37) A laminated fibrous article, which is formed by laminating a sheet onto one or both surfaces of the fibrous article of any one of above (34) to (36).

(38) A laminated fibrous article, which is formed by laminating the fibrous article of any one of above (34) to (36) onto both surfaces of a sheet.

(39) The laminated fibrous article of any one of above (37) or (38), wherein the sheet is at least one selected from non-woven fabrics, films, knitted fabrics and woven fabrics.

(40) An absorbent article comprising the fibrous article of any one of above (34) to (36) or the laminated fibrous article of any one of above (37) to (39).

(41) A wiper comprising the fibrous article of any one of above (34) to (36) or the laminated fibrous article of any one of above (37) to (39).

(42) A battery separator comprising the fibrous article of anyone of above (34) to (36) or the laminated fibrous article of any one of above (37) to (39).

(43) A method for producing splittable polyolefin multi-component fibers, which comprises deforming hollowed multi-component fibers with at least two polyolefin resin components being alternately aligned in the cross section of each fiber, by compressing or rubbing them to thereby peel off the constituent components in at least a part of their contact area.

BRIEF DESCRIPTION OF THE DRAWINGS

In FIG. 1 to FIG. 6;

1 indicates a thermoplastic resin component (A)

2 indicates a thermoplastic resin component (B),

2*b* indicates a partially-lacked segment of component (B)

2*b*' indicates a partially-lacked segment of component (B)

2*b*" indicates a partially-lacked segment of component (B)

2*b*'" indicates a completely-lacked segment of component t (B),

3 indicates a hollow.

Figure 7:
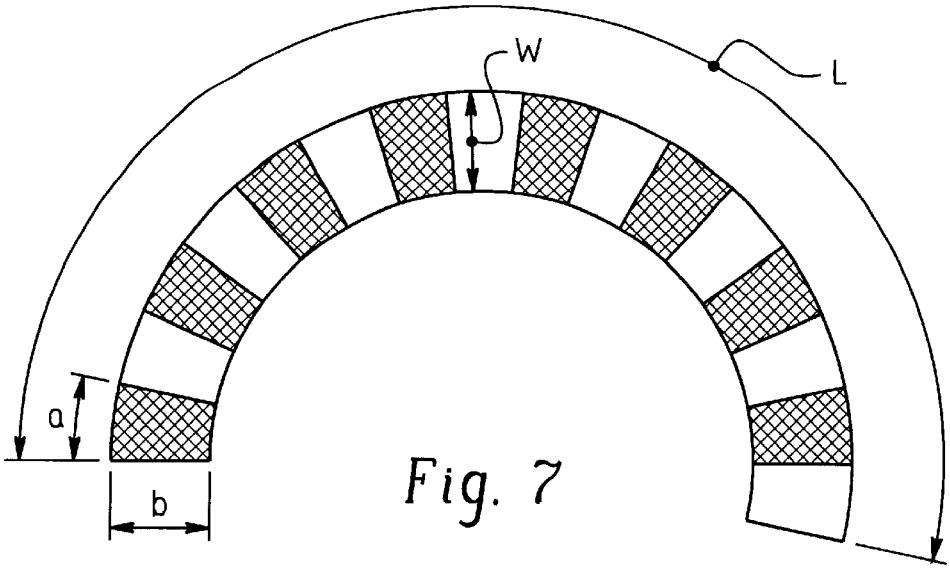

FIG. 7 is a schematic cross-sectional view of one embodiment of the splittable multi-component fiber of the second aspect of the invention.

Figure 8:
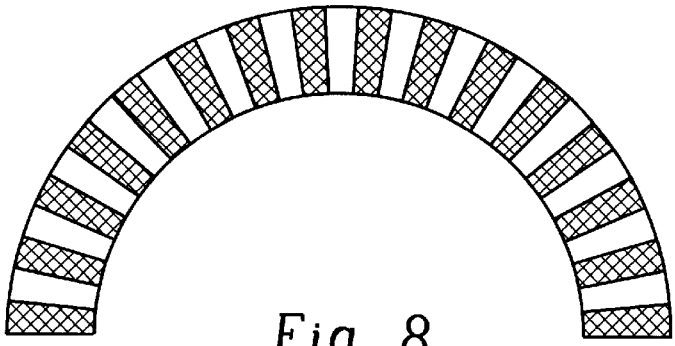

FIG. 8 is a schematic cross-sectional view. of another embodiment of the splittable multi-component fiber of the second aspect of the invention.

Figure 9:
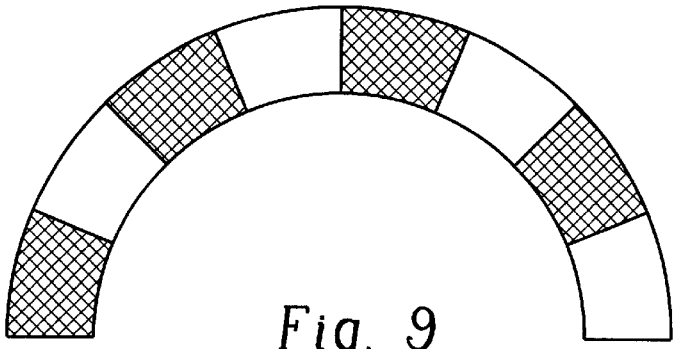

FIG. 9 is a schematic cross-sectional view of still another embodiment of the splittable multi-component fiber of the second aspect of the invention.

Figure 10:
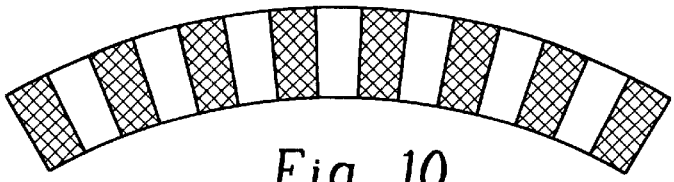

FIG. 10 is a schematic cross-sectional view of still another embodiment of the splittable multi-component fiber of the second aspect of the invention.

Figure 11:
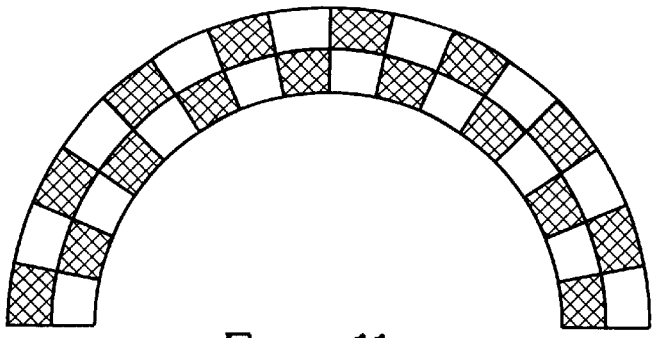

FIG. 11 is a schematic cross-sectional view of still another embodiment of the splittable multi-component fiber of the second aspect of the invention.

Figure 12:
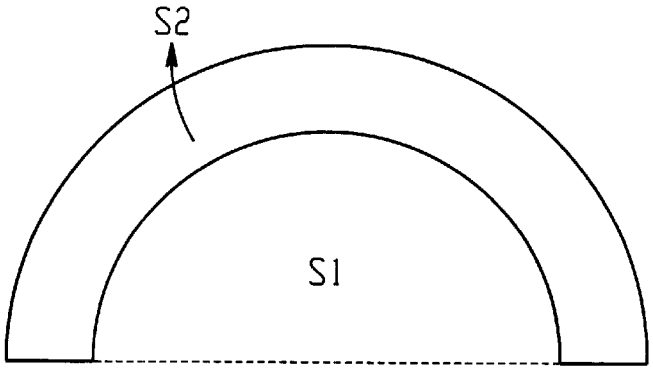

FIG. 12 is a schematic cross-sectional view of, a splittable multi-component fiber of the invention, showing the area (S1) surrounded by the bent or curved constituent components, and the cross-sectional area (S2) of the fiber.

Figure 13:
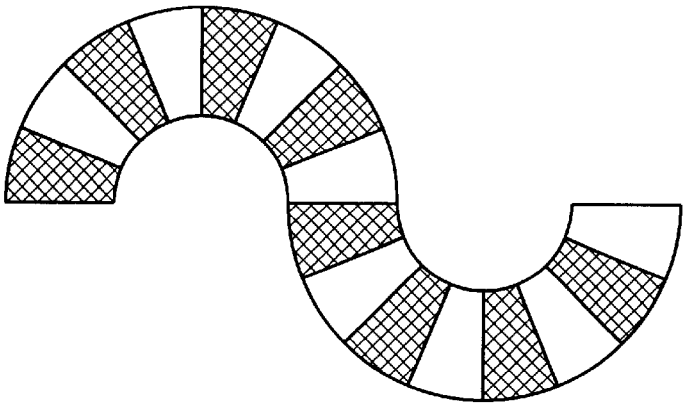

FIG. 13 is a schematic cross-sectional view of still another embodiment of the splittable multi-component fiber of the second aspect of the invention.

Figure 14:
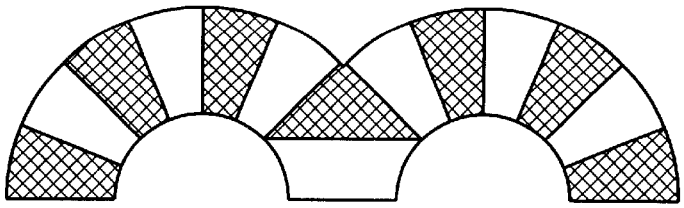

FIG. 14 is a schematic cross-sectional view of still another embodiment of the splittable multi-component fiber of the second aspect of the invention.

Figure 15:
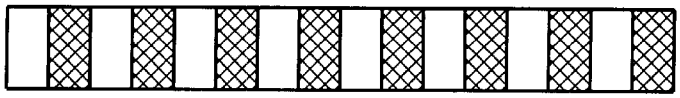

FIG. 15 is a schematic cross-sectional view of the splittable multi-component fiber of Comparative Example 6.

Figure 16:
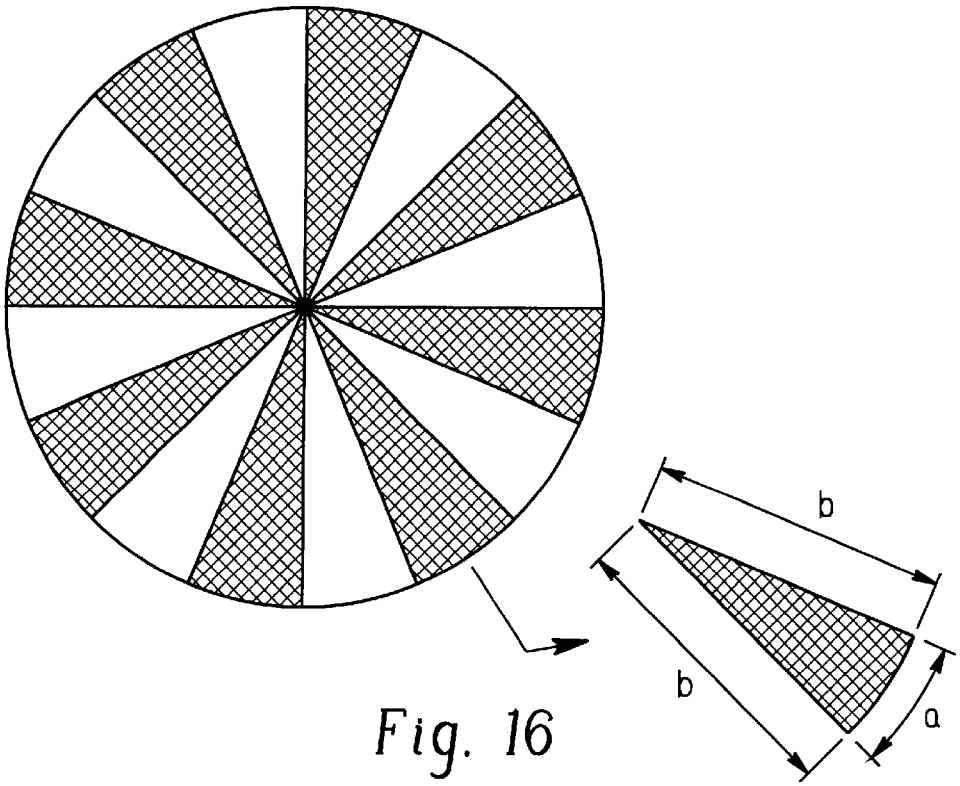

FIG. 16 is a schematic cross-sectional view of the splittable multi-component fiber of Comparative Examples 7 and 8.

In FIG. 7 to FIG. 16;

L indicates the length of the longest part of the cross section of the multi-component fiber in the direction in which the constituent components are alternately aligned to constitute the fiber, W indicates the thickness of the constituent components of the fiber in the direction in which the components are contacted with each other, a indicates the length of the outer periphery of one component of the multi-component fiber, b indicates the contact length of one component that neighbors the adjacent component to constitute the fiber,

S1 indicates the area of the part surrounded by the bent or curved constituent components and the line that connects the both ends of the major axis of the cross section,

S2 indicates the cross-sectional area of the multi-component fiber.

Figure 17:
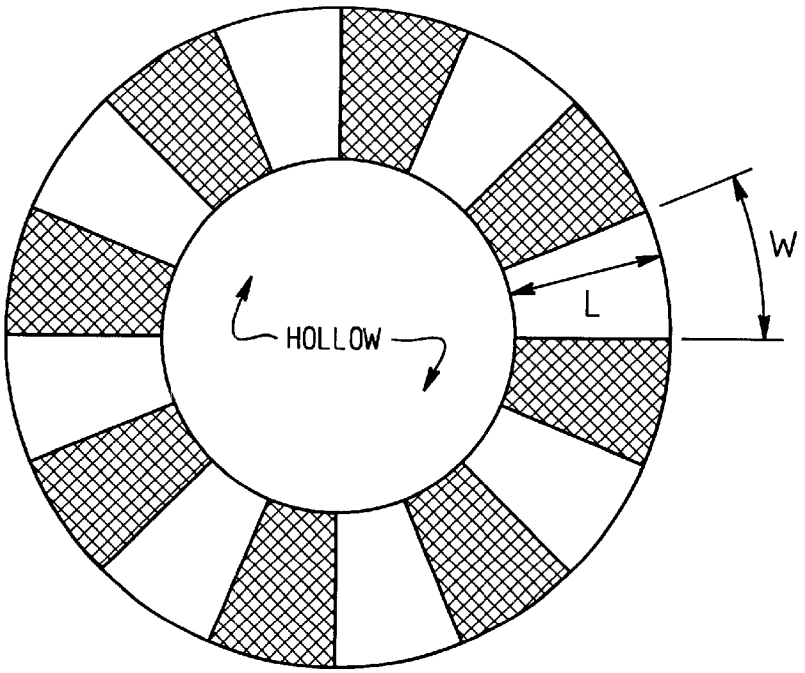

FIG. 17 is a schematic cross-sectional view of one embodiment of the splittable multi-component fiber of the third aspect of the invention.

Figure 18:
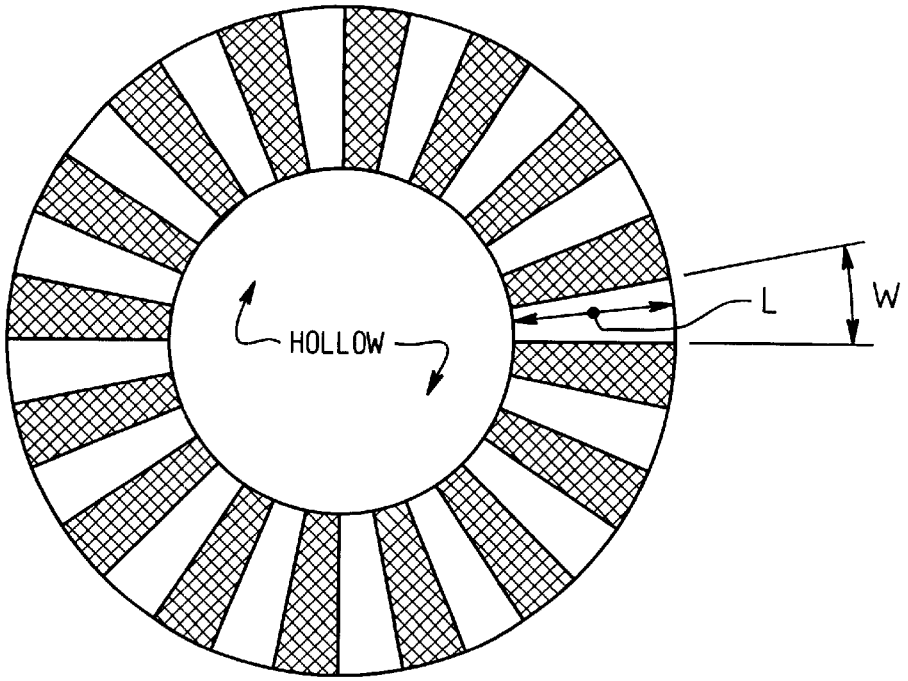

FIG. 18 is a schematic cross-sectional view of another embodiment of the splittable multi-component fiber of the third aspect of the invention.

Figure 19:
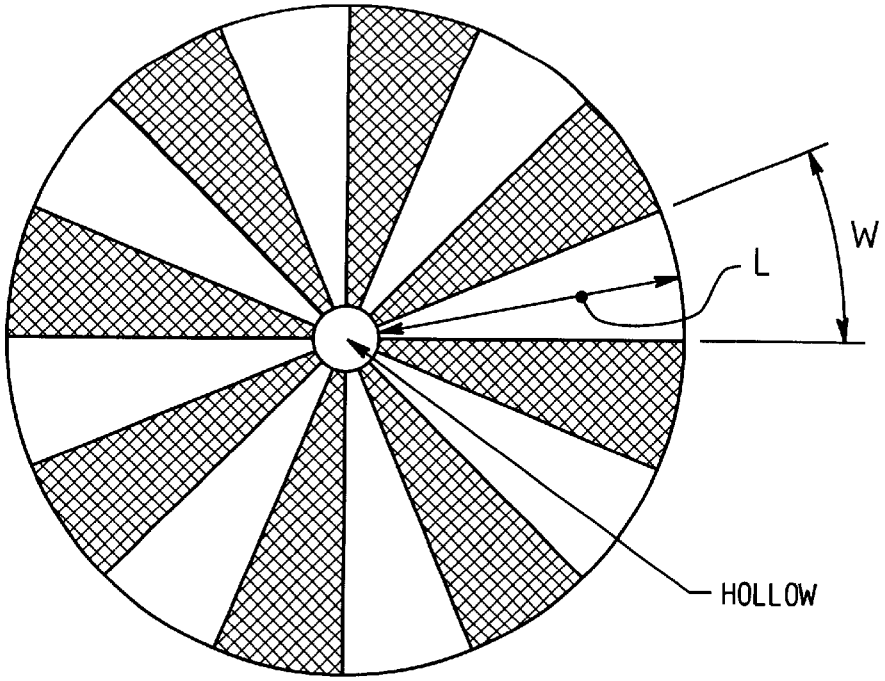

FIG. 19 is a schematic cross-sectional view of the splittable multi-component fiber of Comparative Example 11.

Figure 20:
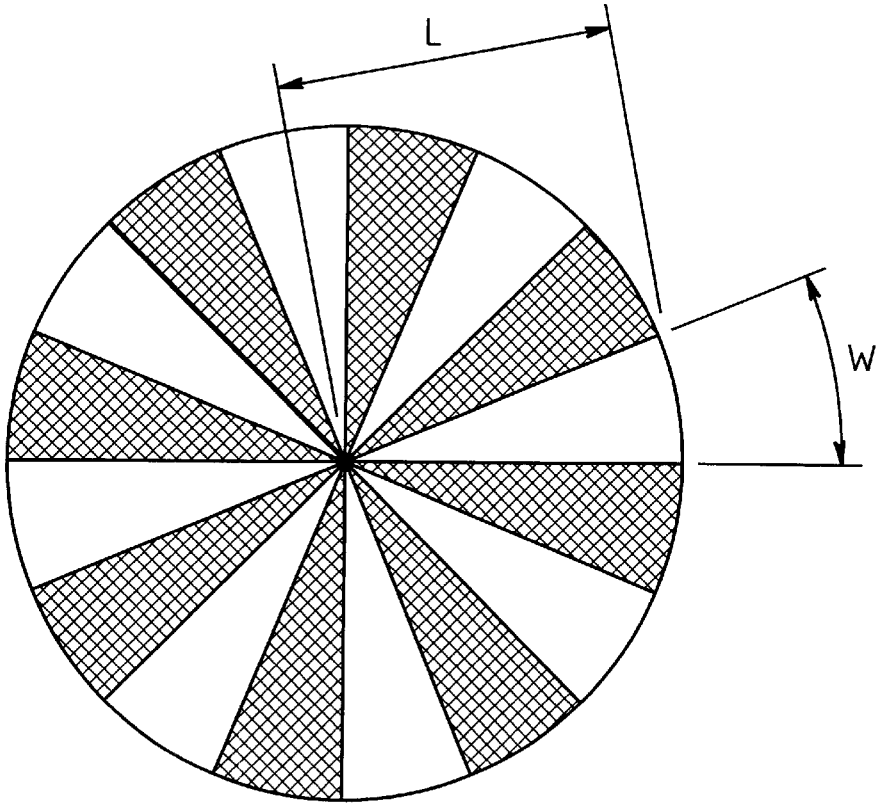

FIG. 20 is a schematic cross-sectional view of the splittable multi-component fiber of Comparative Example 9.

In FIG. 17 to FIG. 20, W indicates the mean length of the outer peripheral arc of one resin component that constitutes the multi-component fiber, L indicates the mean thickness of the multi-component fiber between the end of the hollow and the outer periphery of the fiber.

Figure 21:
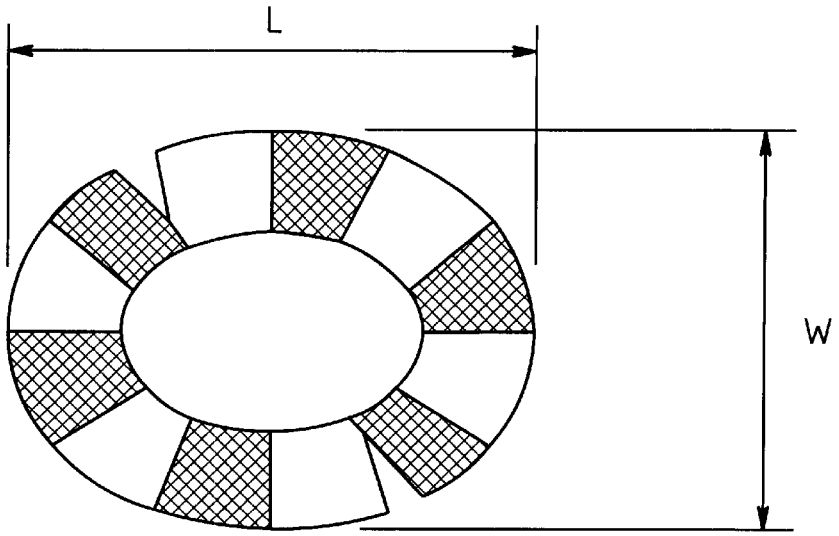

FIG. 21 is a schematic cross-sectional view of one embodiment of the splittable multi-component fiber of the fourth aspect of the invention.

Figure 22:
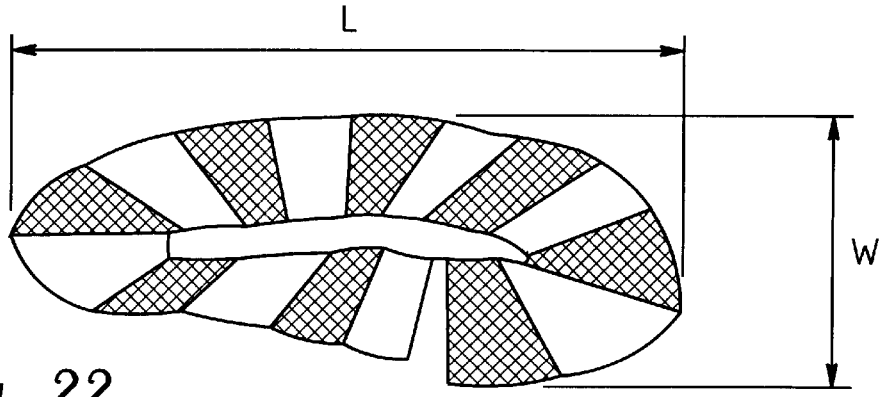

FIG. 22 is a schematic cross-sectional view of another embodiment of the splittable multi-component fiber of the fourth aspect of the invention.

Figure 23:
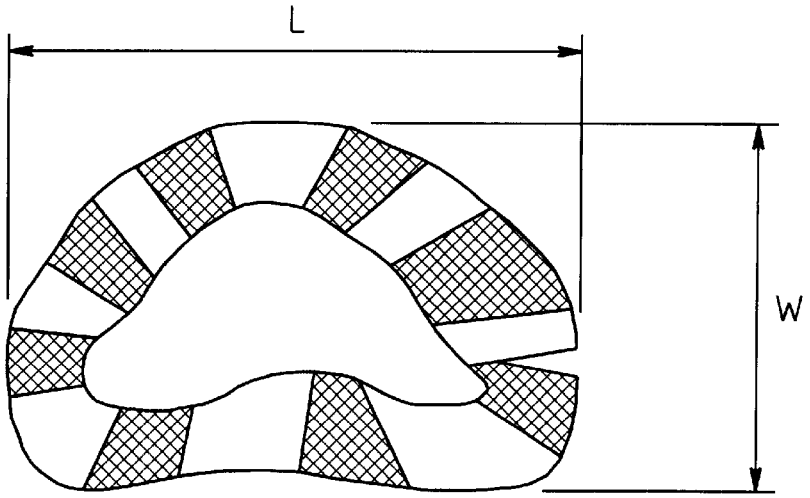

FIG. 23 is a schematic cross-sectional view of still another embodiment of the splittable multi-component fiber of the fourth aspect of the invention.

Figure 24:
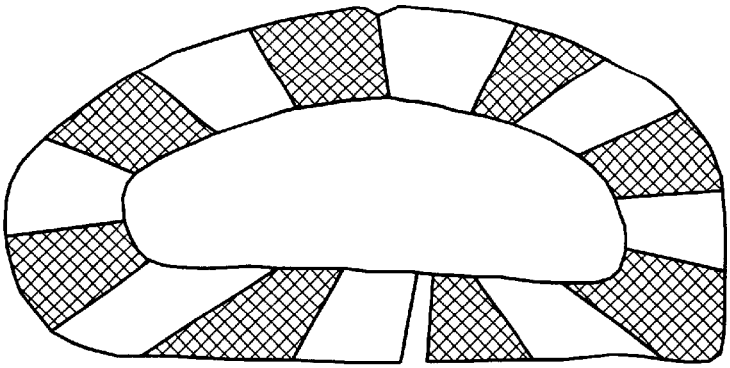

FIG. 24 is a schematic cross-sectional view of still another embodiment of the splittable multi-component fiber of the fourth aspect of the invention.

Figure 25:
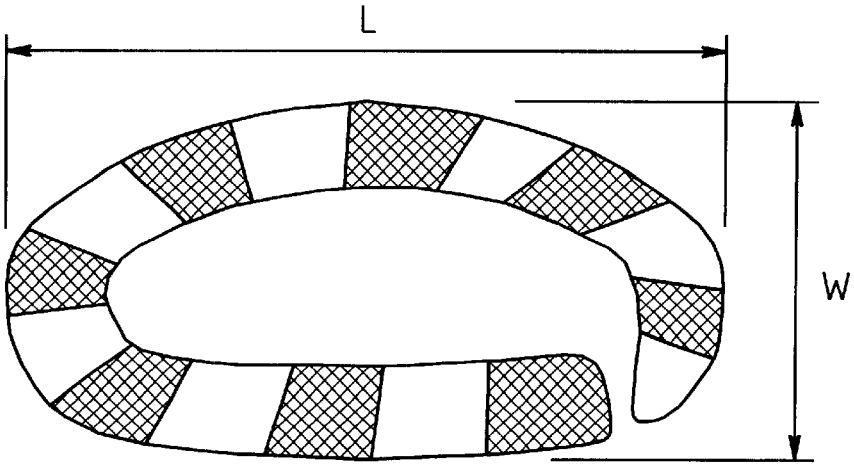

FIG. 25 is a schematic cross-sectional view of still another embodiment of the splittable multi-component fiber of the fourth aspect of the invention.

Figure 26:
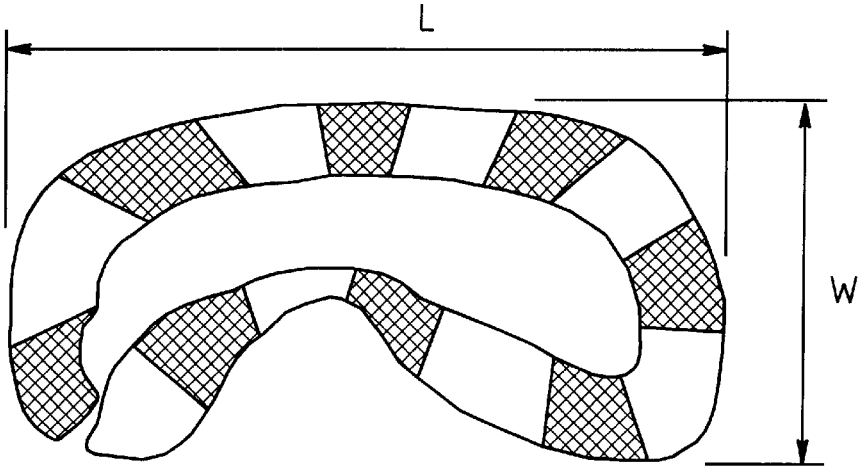

FIG. 26 is a schematic cross-sectional view of still another embodiment of the splittable multi-component fiber of the fourth aspect of the invention.

Figure 27:
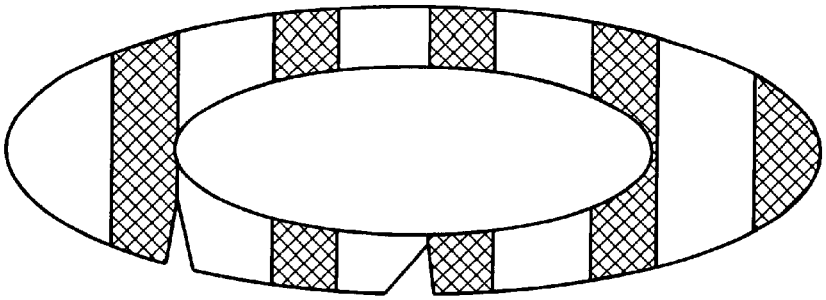

FIG. 27 is a schematic cross-sectional view of still another embodiment of the splittable multi-component fiber of the fourth aspect of the invention.

Figure 28:
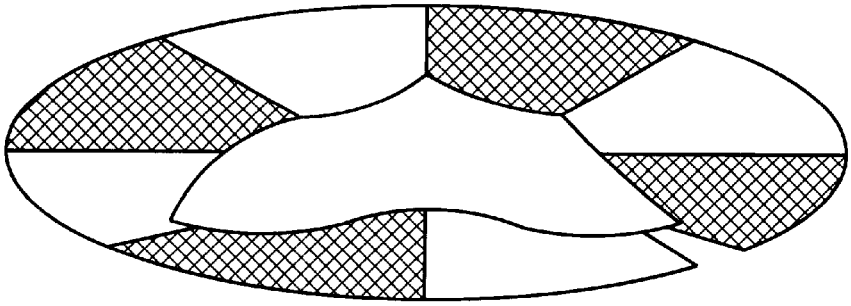

FIG. 28 is a schematic cross-sectional view of still another embodiment of the splittable multi-component fiber of the fourth aspect of the invention.

Figure 29:
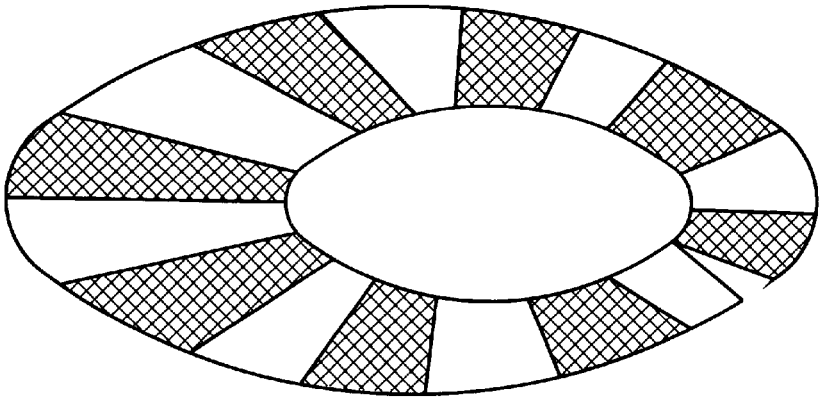

FIG. 29 is a schematic cross-sectional view of still another embodiment of the splittable multi-component fiber of the fourth aspect of the invention.

Figure 30:
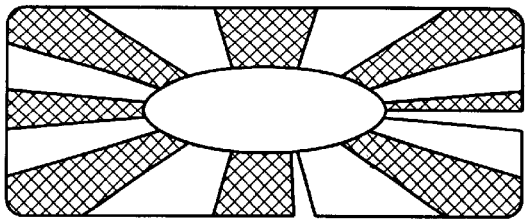

FIG. 30 is a schematic cross-sectional view of still another embodiment of the splittable multi-component fiber of the fourth aspect of the invention.

Figure 31:
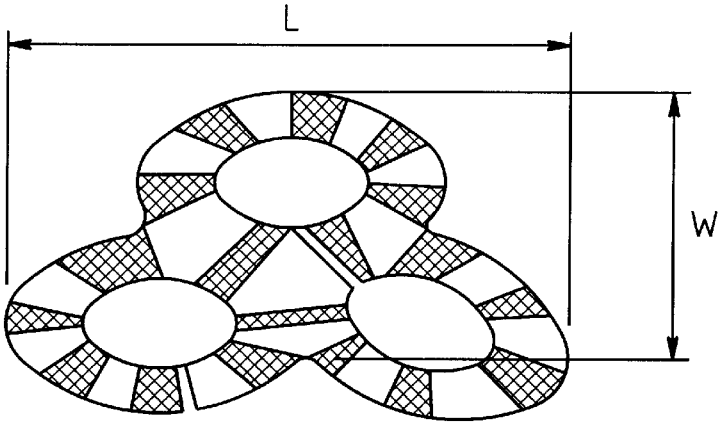

FIG. 31 is a schematic cross-sectional view of still another embodiment of the splittable multi-component fiber of the fourth aspect of the invention.

Figure 32:
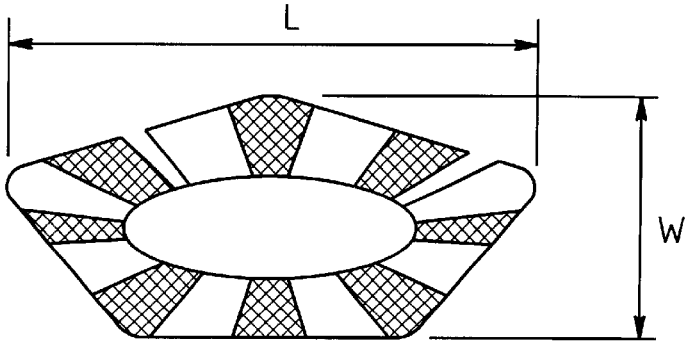

FIG. 32 is a schematic cross-sectional view of still another embodiment of the splittable multi-component fiber of the fourth aspect of the invention.

Figure 33:
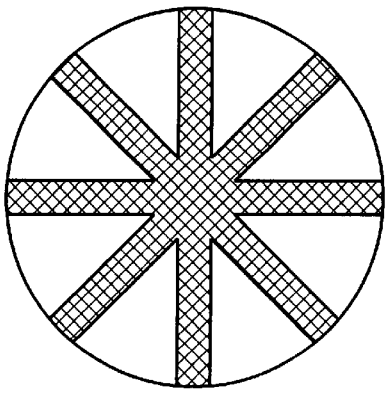

FIG. 33 is a schematic cross-sectional view of the splittable multi-component fiber of Comparative Examples 12 to 14.

In FIG. 21 to FIG. 33;

L (major axis) indicates the length of the longest part of the outer periphery of the multi-component fiber in the cross section, W (minor axis) is perpendicular to the major axis, indicating the length of the shortest part of the outer periphery of the fiber in the cross section.

BEST MODES OF CARRYING OUT THE INVENTION

Figure 1:
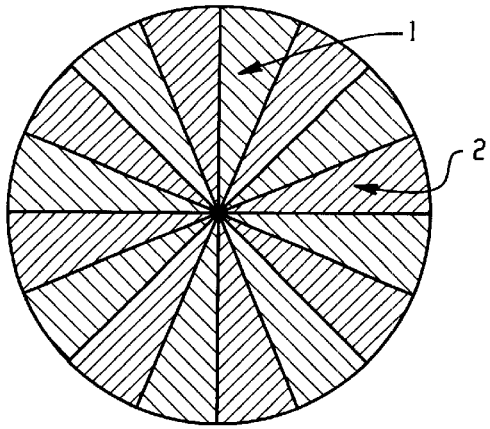
FIG. 1 is a schematic cross-sectional view showing the completely conjugated part of a radially-aligned, splittable multi-component fiber of the first aspect of the invention.
Figure 2:
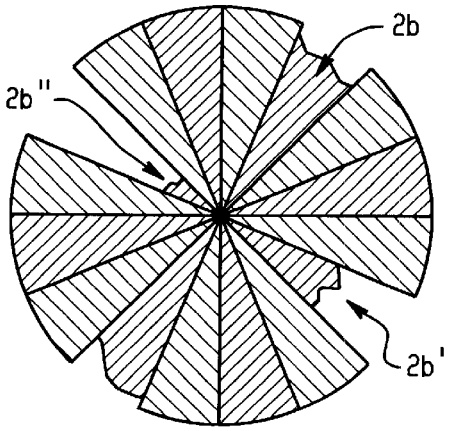
FIG. 2 is a schematic cross-sectional view showing the partially conjugated part of a radially-aligned, splittable multi-component fiber of the first aspect of the invention.
Figure 3:
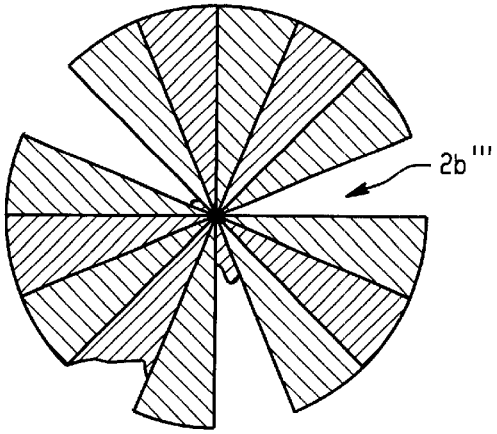
FIG. 3 is a schematic cross-sectional view showing the non-conjugated part of a radially-aligned, splittable multi-component fiber of the first aspect of the invention.

The invention is described in detail hereinunder. The splittable multi-component fiber of the first aspect of the invention comprises components (A) and (B) of thermoplastic resin in which the components are alternately aligned in its cross section. In this, the component (A) is formed continuously in the direction of the fiber axis, and the component (B) is so randomly formed that some of it is conjugated to the component (A) in the direction of the fiber axis to give a completely conjugated part (in FIG. 1 illustrating the cross section of the fiber, 1 indicates the component (A) and 2 indicates the component (B)) and some others of it are broken in the direction of the fiber axis to give a partially conjugated part in which the area conjugated to the component (A) is smaller than that in the completely conjugated part (in FIG. 2 illustrating the cross section of the fiber, 2*b*, 2*b*' and 2*b*" all indicate the partially conjugated part) and/or a non-conjugated part in which the component (B) lacks in the direction of the fiber axis and is not conjugated to the component (A) (in FIG. 3 illustrating the cross section of the fiber, 2*b*"' indicates the non-conjugated part). In one fiber, all these completely-conjugated part, partially-conjugated part and non-conjugated part of the component (B) exist at random.

As having the structure defined herein, the splittable multi-component fiber of the first aspect of the invention can readily receive concentrated physical stress from high-pressure liquid jets or the like applied thereto. In other words, in the fiber, the segments of the component (A) run continuously throughout the fiber in the direction of the fiber axis to thereby ensure the essential fiber strength, while some of the segments of the component (B) are partially lacked to such a degree that at least one segment of the component (A) is not completely exposed outside, thereby forming the partially-conjugated parts 2*b*, 2*b*' and 2*b*" in the cross section of the fiber (FIG. 2) and/or completely lacked to such a degree that at least one, segment of the component (A) is completely exposed outside, thereby forming the non-conjugated part 2*b*"' therein (FIG. 3), and in one fiber, all these completely-conjugated part, partially-conjugated part and non-conjugated part of the component (B) exist at random. Therefore, the fiber shall have discontinuous hollow in the direction of the fiber axis. Accordingly, when compared with any other fibers not having such hollow on the surface, the fiber of the invention can more readily receive physical stress applied thereto and therefore can be readily split into fine fibers by any small impact energy applied thereto.

The discontinuous hollow include regular and irregular hollow with respect to their length and depth in the direction of the fiber axis, and their shape, length and depth are not defined in any way. In other words, the hollow may be inclined at an acute angle, a right angle or an obtuse angle to the adjacent component (A) in the cross section in the direction of the fiber axis. Regarding their depth, they may be shallow (like 2*b* in FIG. 2), or deep to such a degree that the adjacent component (A) is completely exposed outside (like 2*b*''' in FIG. 3). It is rather desirable that the component (A) is exposed outside as much as possible, as in FIG. 3. If the discontinuous ⌴ parts in the segments of the component (B) shall be at least formed, the discontinuous hollow therein are not specifically defined with respect to their shape and form.

The thermoplastic resin for the component (A) in the first aspect of the invention is not specifically defined, so far as it can form fibers and can be melt-spun in ordinary melt-spinning devices. For example, it includes polyolefin resin, thermoplastic polyester resin, polyamide resin, stereo-specific polystyrene resin, and their mixtures, etc.

The segments of the component (A) in the first aspect of the invention may be made of a single resin only, or a mixture of two or more of different resins. Accordingly, the segments of the component (A) include a plurality of segments of segment (A1), segment (A2), etc. In that case, it is desirable that, in the cross section of the fiber, the segment (A1) and the segment (A2) are not directly adjacent to each other but a segment of the component (B) is interposed between them. The same shall apply also to the segments of the component (B). For example, in case where two different types of resin are used for the component (B) to give different types of segments (B1) and (B2), it is desirable that, in the cross section of the fiber, the segment (B1) and the segment (B2) are not directly adjacent to each other but a segment of the component (A) is interposed between them.

The polyolefin resin for use in the invention includes, for example, high-density polyethylene (HDPE), linear low-density polyethylene (LLDPE), polypropylene resin, polymethylpentene, 1,2- or 1,4-polybutadiene, as well as homopolymers of α-olefins such as ethylene, butene-1, hexene-1, octene-1, 4-methylpentene-1 or the like, and also copolymers of two or more different types of such α-olefins. Especially preferred are polypropylene resins such as ethylene-propylene copolymer, ethylene-propylene-1-butene tercopolymer, etc.; and mixtures of two or more of them. Also preferred are copolymers of α-olefins such as those mentioned above with any other olefins or with a small amount of any other ethylenic unsaturated monomers such as butadiene, isoprene, 1,3-pentadiene, styrene, α-methylstyrene, etc. Mixtures of two or more different types of polyolefin resin are also usable herein. Not only polyolefin resins produced through polymerization in the presence of an ordinary Ziegler-Natta catalyst, but also other polyolefin resins and their copolymers produced through polymerization in the presence of a metallocene catalyst are also preferred for use herein.

The thermoplastic polyester resin for use herein includes, for example, homopolyesters and copolyesters to be produced from an acid component of aromatic dicarboxylic acids such as terephthalic acid, isophthalic acid, 2,6-naphthalenedicarboxylic acid, etc.; or aliphatic dicarboxylic acids such as adipic acid, sebacic acid, etc.; or their esters, and an alcohol component of diol compounds such as ethylene glycol, diethylene glycol, 1,4-butanediol, neopentyl glycol, 1,4-cyclohexanedimethanol, etc.

The polyamide resin for use herein includes, for example, nylon-4, nylon-6, nylon- 46, nylon-66, nylon-610, nylon-11, nylon-12, polymetaxyleneadipamide(MXD-6), polyparaxylenedecanamide(PXD-12), polybiscyclohexylmethanedecanamide(PCM-12), and also copolyamides comprising constituent units of their monomers.

Stereo-specific polystyrene resin can be identified by its tacticity in $^{13}$C-NMR, concretely by the fractional proportion of a plurality of constituent units directly connected in series therein, for example, by the diad fraction, the triad fraction or the pentad fraction of two, three or five constituent units directly connected in series therein, respectively. The stereo-specific polystyrene resin for use in the invention will generally have syndiotacticity of at least 85%, but preferably at least 95%, in terms of the pentad fraction therein, including, for example, polystyrene; polyalkylstyrenes such as polymethylstyrene, polyethylstyrene, polyisopropylstyrene, etc.; polyhalogenostyrenes such as polychlorostyrene, polybromostyrene, polyfluorostyrene, etc.; polyhalogenoalkylstyrenes such as polychloromethylstyrene, etc.; polyalkoxystyrenes such as polymethoxystyrene, polyethoxystyrene, etc.; polystyrene benzoates, etc. Needless-to-say, one or more of these polymers may be used herein either singly or as combined. In addition, copolymers of the monomers for these polymers, and also copolymers essentially comprising the monomers are also usable herein.

Concretely, the copolymers will be formed from at least one monomer selected from the monomer group mentioned above and a comonomer selected from olefin monomers such as ethylene, propylene, butene, hexene, heptene, octene, decene, etc.; diene monomers such as butadiene, isoprene, etc.; cyclic olefin monomers, cyclic diene monomers; or polar vinyl monomers such as methyl methacrylate, maleic anhydride, acrylonitrile, etc., and have a syndiotactic styrene structure. These homopolymers and copolymers are available on the market, and any commercial products are usable herein.

The thermoplastic resin for the component (B) to form the segments having discontinuous hollow in the fiber of the invention is not specifically defined, so far as it is non-miscible with the component (A) and can form the intended segments having a partially conjugated part and a non-conjugated part being present at random therein to have discontinuous hollow. Most preferably, the thermoplastic resin for the component (B) is low-density polyethylene to which is added no additive. This can be formed into the segments by itself with the intended hollow therein. The low-density polyethylene referred to herein is a type of polyethylene resin having a melting point of from 105 to 120° C. and a specific gravity of from 0.915 to 0.930 and capable of forming fibers. In case where low-density polyethylene is used for the component (B) in producing the splittable multi-component fiber of the invention, it cannot follow the thermoplastic resin of the component (A) in the step of drawing, the non-drawing fiber just having been spun in melt, and therefore it is partly broken in the drawing fiber to thereby form a partially conjugated part and a non-conjugated part therein.

On the other hand, herein employable is another method for forming the partially conjugated part and the non-conjugated part in the segments of the thermoplastic resin component (B), not using the above-mentioned low-density polyethylene. This comprises adding an inorganic or organic foaming agent to thermoplastic resin such as that mentioned above to such a degree that the agent added does not detract from the spinnability and other fibrous properties of the resulting resin, and using the resulting resin for the component (B). The foaming agent typically includes azo compounds such as azodicarbonamide, azobisisobutyronitrile, etc.; nitroso compounds such as N,N'-dinitrosopentamethylenetetramine, etc.; sulfonylhydrazide compounds such as p-toluenesulfonylhydrazine, p,p'-oxybis (benzenesulfonylhydrazide), etc. In this case, the foaming agent is not added to the thermoplastic resin for the component (A) but is added to only the thermoplastic resin for the component (B) and the resulting splittable multi-component fiber shall comprise the component (A) with no foaming agent and the component (B) containing the foaming agent added. For adding the foaming agent to the component (B), for example, employable is a method of adding it to the resin for the component (B) and mixing them in the process of melt-spinning the resin, or a method of adding it to the resin for the component (B), kneading them and pelletizing the resulting mixture, separately from the melt-spinning process.

The amount of the foaming agent to be added shall be varied, depending on the fineness of the intended fiber and the type of the foaming agent. In general, it may fall between 0.1 and 2.0% by weight, but preferably between 0.2 and 1.0% by weight of the thermoplastic resin for the component (B) to which the agent is added. The segments of the component (B) that has foamed in the splittable multi-component fiber formed shall have bubbles or the hollow therein. Accordingly, even the non-drawing fiber will have the discontinuous hollow or bubbles in the segments of the component (B) aligned in the direction of the fiber axis, whereby the contact area between the components (A) and (B) therein is reduced. As a result, it can be readily split into fine fibers. If desired, the non-drawing fiber can be drawn whereby the hollow and the bubbles therein are expanded, and the splittability of the thus-drawing fibers is enhanced more than that of the non-drawing fiber. For this, the drawing ratio preferably falls between 70 and 90% of the drawing ratio at break of the non-drawing fiber. In the preferred manner, the splittable multi-component fiber produced could have the discontinuous hollow with a partially conjugated part and/or a non-conjugated part existing at random therein in the direction of the fiber axis.

If desired, additives such as antioxidant, light stabilizer, UV absorbent, neutralizing agent, nucleating agent, epoxy stabilizer, lubricant, antimicrobial agent, flame retardant, antistatic agent, pigment, plasticizer, etc., may be added to the thermoplastic resin for use in the first aspect of the invention, not interfering with the effect of the invention.

In the cross section of the splittable multi-component fiber of the first aspect of the invention, the number of splittable segments of the components (A) and (B) is not specifically defined, but shall be at least 3. Preferably, the number of splittable segments of the constituent components therein falls between 4 and 32 or so for facilitating the fiber production, but it depends on the fineness of the fine fibers from the split multi-component fiber. More preferably, the number of splittable segments of the constituent components in the fiber is so controlled that the fine fibers from the split multi-component fiber could have a single fiber fineness of at most 0.5 dtex, even more preferably at most 0.3 dtex. The splittable multi-component fiber produced in such a preferred embodiment could be formed into highly flexible and tight non-woven fabrics.

The cross section of the splittable multi-component fiber of the first aspect of the invention may have, for example, a radial profile (see FIG. 1 to FIG. 3), a hollowed radial profile (see FIG. 4), a multi-layered profile (see FIG. 5), etc. However, the cross-section profile of the fiber is not specifically defined, so far as the component (B) in the fiber has the discontinuous hollow and the fiber can ensure a fibrous shape by itself. It is desirable that the components (A) and (B) are alternately aligned in the cross section of the fiber. In other words, it is undesirable that one segment of one component completely surrounds the other segment of the other component adjacent thereto, for example, like in core/shell multi-component fibers.

The splittable multi-component fiber of the first aspect of the invention is split into fine fibers by physical impact of, for example, high-pressure liquid jets or the like applied thereto. Therefore, its cross-section profile is not limited to the circular embodiments as in FIG. 1 to FIG. 5. More preferably, therefore, the cross section of the fiber has a star-shaped profile (non-circular profile), as the fiber can more surely receive physical impact applied thereto. For example, the irregular cross-section profile of the fiber includes, in addition to such a star-shaped profile (see FIG. 6), other oval, triangular, square, hexagonal, multi-leaved, array-shaped, T-shaped, and horseshoe-shaped profiles, etc. Anyhow, the cross section of the fiber is not specifically defined, so far as the fiber can surely receive physical impact applied thereto and can be readily split into fine fibers to attain the essential object of the first aspect of the invention. Accordingly, the configuration of the constituent components of the fiber and the cross-section profile of the fiber are not whatsoever limited to those illustrated herein.

In the splittable multi-component fiber of the first aspect of the invention, the blend ratio of-the thermoplastic resins, component (A) to component (B) falls between 10/90% by weight and 90/10% by weight. In case where a plurality of different types of resin are used for the component (A) and the component (B), the total of the resins shall be 100% by weight. More preferably, the ratio falls between 30/70% by weight and 70/30%, by weight. Within the defined range, the two components (A) and (B) of thermoplastic resin can be uniformly aligned in the cross section of the fiber.

One embodiment of the method for producing the splittable multi-component fiber of the first aspect of the invention is described. A thermoplastic resin for the component (A) and a thermoplastic resin for the component (B) are separately melted, and spun out through a multi-component spinneret having, for example, from 300 to 1000 orifices. In this step, the spinneret is cooled with air just below it, and non-drawn multi-component fibers are thus obtained. The take-up speed falls between 40 m/min and 1500 m/min, and the non-drawn fibers thus obtained have a fineness falling between 3 dtex and 400 dtex. In case where a polypropylene resin and a polyethylene resin are combined for the two constituent components, the non-drawn fibers are drawn between rolls heated at 60 to 120° C. or in a hot water bath heated at 70 to 90° C.

While the melt-spun, non-drawn multi-component fibers are drawn, their cross-section profile shall have, in addition to a completely conjugated part (FIG. 1), the discontinuous hollow of a partially conjugated part (2*b*, 2*b*', 2*b*" in FIG. 2) and/or a non-conjugated part (FIG. 3) existing at random therein. In the drawing step, the component (B) that has failed to follow the component (A) gives partially the discontinuous hollow in the drawn fibers. In this step, the drawing ratio must be enough for partial breakage of the component (B). Concretely, it is desirable that the drawing ratio in the step falls between 50 and 90% of the drawing ratio at break of the non-drawn fibers. If the drawing ratio is smaller than the defined range, the component (B) could not be broken; but if larger than it, the fibers being drawn will be cut and could not be drawn.

Using a tough roll, a finishing agent is applied to the thus-obtained, drawn fibers. The fibers are then passed through a crimper box, and are crimped therein to be crimped tows. Preferably, the number of crimps falls between 0 and 25 hills/25 mm. The tows contain about 10% by weight of water, and are dried in a drier. In case where a polypropylene resin is combined with a polyethylene resin for the two constituent components, the twos are dried at 60 to 120° C. The dried tows are cut with a pressure cutter into short fibers having a predetermined length. This process is for producing short fibers. Apart from this, the long tows produced may be, without being cut into short fibers, passed through a dividing guide into webs. If desired, the resulting short fibers or webs may be further processed and worked into fibrous articles for various applications.

The fibrous article referred to herein is meant to indicate any type of fabric-like article, including, for example, woven fabrics, knitted fabrics, non-woven fabrics, etc. They may be produced by any method of mixing, blending or combining different types of fibers, or even twisting, weaving or combining union fibers or filaments.

In the process of producing such fibrous articles, a surfactant may be applied to the spun fibers, which is for preventing the fibers from being statically charged, for improving the workability of the fibers into fibrous articles and for leveling the fibers. The type and the concentration of the surfactant will be appropriately selected and controlled depending on the use of the fibers. For applying such a surfactant to the fibers, for example, employable is a roller method, a dipping method or a patting and drying method. The surfactant may be applied to the fibers in any stage of spinning, drawing or crimping the fibers. Irrespective of short fibers or long fibers, the surfactant may be applied thereto in any stage other than the stage of spinning, drawing or crimping the fibers. For example, it may be applied to final fibrous products.

The length of the splittable multi-component fiber of the first aspect of the invention is not specifically defined. For example, in case where webs are produced by the use of a carding machine, the fibers for them will generally have a length falling between 20 and 76 mm. On the other hand, in case where they are produced in a wet-laying process or in an air-laying process, the fibers for them will preferably have a length falling between 2 and 20 mm. However, fibers shorter than 2 mm will move when physical impact is applied thereto, and they can hardly receive the energy necessary for their split. Fibers far longer than 76 mm could not be stably formed into uniform webs in a carding machine or the like, and the webs from them will be rough.

The fineness of the splittable multi-component fiber is not also specifically defined, but preferably falls between 1 and 100 dtex, more preferably between 1.5 and 35 dtex, even more preferably between 1.5 and 20 dtex. Too fine fibers having a fineness of far smaller than 1 dtex could not smoothly pass through a carding machine, and their productivity will be low. On the other hand, too thick fibers having a fineness of far larger than 100 dtex will be entangled to a great extent, and their dispersibility is low. Such thick fibers could not be formed into uniform webs. Having a fineness of from 1 to 100 dtex, the splittable multi-component fibers are favorable as they can smoothly pass through a carding machine and can be formed into good webs at high productivity, and the webs from them are uniform and are not rough.

One embodiment of producing a fibrous article that comprises splittable multi-component fibers of the first aspect of the invention is described. This is for producing a non-woven fabric. Splittable multi-component, short fibers of the invention are formed into a web having a predetermined weight, according to a carding method, an air-laying method or a wet-laying method. If desired, the web may be directly formed according to a melt-blowing method, spun-bond method or the like. In the web thus produced, the constituent fibers are split into fine fibers in any known method of, for example, needle-punching the web or processing it with high-pressure liquid jets. From the web thus processed, produced is the intended fibrous article, non-woven fabric. If desired, the fibrous article may be further processed with hot air, hot rolls or the like in any known manner.

In case where a web produced from extremely short fibers in a wet-laying process or the like is processed in such a known method of, for example, needle-punching it or applying high-pressure liquid jets thereto so as to split the constituent fibers into fine fibers, the constituent fibers being split by the physical stress applied thereto will move to worsen the uniformity of the web. To evade the problem, for example, some other fibers capable of melting at a temperature lower than the melting point of the resin that constitutes the splittable multi-component fibers will be blended with the multi-component fibers before the fibers are formed into a web. In the web, the multi-component fibers will be stabilized by the low-melting-point fibers having melted therearound, and the non-woven fabric from the web could have uniformity.

In case where the web is produced according to a wet process, the dispersibility in water of the fibers for it must be taken into consideration. In this case, therefore, it is desirable that the fibers for the web are not crimped. On the other hand, in case where the web is produced according to a dry process, its cardability must be taken into consideration. In this case, therefore, it is desirable that the fibers for the web are crimped. The crimp form and the number of crimps shall be appropriately determined depending on the fineness of the fibers to be crimped. For the fibers having a fineness of 1 dtex, the number of crimps preferably falls between 10 and 20 hills/25 mm or so; and for those having a fineness of 100 dtex, it preferably falls between 4 and 9 hills/25 mm or so. For thicker fibers having a larger value of fineness, the number of crimps could be smaller.

The weight of the fibrous article of the first aspect of the invention is not specifically defined, but preferably falls between 10 and 200 g/m$^2$. Non-woven fabrics having the weight of smaller than 10 g/m$^2$ will have ununiformity.

For non-woven fabrics having a weight of larger than 200 g/m$^2$, the pressure of the liquid jets to be applied to the webs for splitting the multi-component fibers into fine fibers will have to be increased, and the multi-component fibers in the webs will be roughly split into fine fibers. As a result, it will be difficult to obtain uniform non-woven fabrics having uniformity.

The surface of the splittable multi-component fiber of the invention produced in the manner as above has a partially and randomly broken and/or lacked structure, and the fiber is not so stiff. If desired, therefore, the fibers may be combined with any other fibers not interfering with them. For the additional fibers, usable are synthetic fibers of polyamides, polyesters, polyolefins, acrylic resins, etc.; natural fibers of cotton, wool, hemp, etc.; regenerated fibers of rayon, cupra, acetate, etc.; semi-synthetic fibers, etc.

The thermoplastic resin for the splittable multi-component fiber of the second aspect of the invention is not specifically defined, so far as it can be melt-spun into fibers. It may be the same as the thermoplastic resin for the splittable multi-component fiber of the first aspect of the invention described hereinabove, and its preferred examples are polyester resin, polyamide resin, polyolefin resin, etc. Concretely, the polyester resin includes, for example, homopolyesters and copolyesters to be produced from an acid component of aromatic dicarboxylic acids such as terephthalic acid, isophthalic acid, phthalic acid, 2,6-naphthalenedicarboxylic acid, etc.; or aliphatic dicarboxylic acids such as adipic acid, sebacic acid, etc.; or their esters, and an alcohol component of diol compounds such as ethylene glycol, diethylene glycol, 1,4-butanediol, neopentyl glycol, 1,4-cyclohexanedimethanol, etc. These polyesters may be blended with or copolymerized with parahydroxybenzoic acid, 5-sodium-sulfoisophthalic acid, polyalkylene glycol, pentaerythritol, etc.

The polyamide resin includes, for example, 6,6-nylon, 6,10-nylon, 6-nylon, 1,1-nylon, 1,2-nylon, 4-nylon, 4,6-nylon, and also copolymers essentially comprising them.

The polyolefin resin includes, for example, homopolymers of aliphatic α-olefins having from 2 to 8 carbon atoms, such as ethylene, propylene, 1-butene, 1-pentene, 4-methyl-1-pentene, 3-methyl-1-butene, 1-hexene, 1-octene, etc., or copolymers of at least two different types of these α-olefins; copolymers of such α-olefins with any other olefins and/or other minor, ethylenic unsaturated monomers such as butadiene, isoprene, styrene, α-methylstyrene, etc., and also mixtures of two or more of these. Typically mentioned for these are polypropylene resin and polyethylene resin. The polypropylene resin includes, for example, propylene homopolymers, copolymers of propylene and at least one of α-olefins except propylene such as those mentioned above, of which the propylene content is at least 70% by weight, for example, ethylene-propylene copolymers, ethylene-propylene-butene copolymers, etc.

The polyethylene resin includes, for example, high-density polyethylene (HDPE), low-density polyethylene (LDPE), linear low-density polyethylene (L-LDPE), etc.

The melt flow rate (MFR, at 230° C. under 21.18 N) of the polypropylene resin and MFR (at 190° C. under 21.18 N) of the polyethylene resin are not specifically defined, so far as they are within a range within which the resins can be spun into fibers. Preferably, MFR of the resins falls between 1 and 100 g/10 min, more preferably between 5 and 70 g/10 min.

Except those mentioned above, vinyl polymers are also usable as the thermoplastic resin. They include, for example, polyvinyl alcohols, polyvinyl acetates, polyacrylates, ethylene-vinyl acetate copolymers, syndiotactic polystyrenes, and their copolymers.

Of the thermoplastic resins mentioned above, at least two different types may be combined in any desired manner for the splittable multi-component fiber of the second aspect of the invention. For clothing materials to be dyed, for example, preferred are combinations essentially comprising polyester resin or polyamide resin. For industrial materials and sanitary materials which are required to be resistant to chemicals, lightweight and inexpensive, preferred are combinations essentially comprising inexpensive and chemical-resistant polyolefin resin. Especially for the materials that are required to have good chemical resistance, preferred is a combination of polypropylene resin and polyethylene resin.

The thermoplastic resins may be combined in any desired manner for the fiber of the invention. However, a combination of resins that are just the same, for example, a combination of polyethyleneterephthalate resin and polyethylene terephthalate resin, or a combination of polypropylene. resin and polypropylene resin, and a combination of mixtures having the same constitutional ratio shall be excluded from the scope of the invention.

In the preferred combination of two components, polypropylene resin and polyethylene resin, for the splittable multi-component fiber of the second aspect of the invention, the polypropylene resin is the high-melting-point resin, component A. Concretely, the polypropylene resin includes syndiotactic polypropylene and isotactic polypropylene produced through polymerization in the presence of, for example, a Ziegler-Natta catalyst or a metallocene catalyst. The high-melting-point polypropylene resin is acceptable herein so far as its MFR-A falls within a range within which the resin is spinnable in melt. Concretely, the resin, if so controlled that its fibers could have MFR-A falling within a range of from 10 to 100 g/10 min, for example, by changing the spinning condition for it, involves no specific problem. More preferably, the resin has, after having formed fibers, MFR-A falling between 10 and 70 g/10 min. If it has, after having formed fibers, MFR-A lower than 10 g/10 min or higher than 100 g/10 min, the resin will be difficult to well spin into fine fibers.

In the combination, the polyethylene resin is the low-melting-point resin, component B, of which the melting point is lower than that of the above-mentioned polypropylene resin. Concretely, it includes high-density polyethylene, linear low-density polyethylene, and low-density polyethylene. A mixture of two or more of such polyethylenes may also be the low-melting-point resin component. The starting polyethylene resin is acceptable herein so far as its MFR-B falls within a range within which the resin is spinnable in melt. Concretely, the resin, if so controlled that its fibers could have MFR-B falling within a range of from 10 to 100 g/10 min, for example, by changing the spinning condition for it, involves no specific problem. More preferably, the resin has, after having formed fibers, MFR-B falling between 10 and 60 g/10 min. If it has, after having formed fibers, MFR-B lower than 10 g/10 min or higher than 100 g/10 min, the resin will be difficult to well spin into fine fibers.

Preferably, the splittable multi-component fiber of the second aspect of the invention that comprises at least two thermoplastic resin components is such that the ratio of the melt flow rate, MFR-A, of the constituent resin component (A) having the highest melting point of all to the melt flow rate, MFR-B, of the constituent resin component (B) having the lowest melting point of all, MFR-A/MFR-B falls between 0. 1 and 5, more preferably between 0.5 and 3. If the ratio is smaller than 0.1 or larger than 5, the resin mixture for the fiber could hardly ensure good spinnability. This is because, if so, the difference between the two resins in the fluidity through spinnerets through which they are melt-spun into fibers, the melt tension of the spun fibers having a bent, curved or flattened cross-section profile, and even the viscosity increase in cooling the spun fibers will be great.

If desired, additives such as antioxidant, light stabilizer, UV absorbent, neutralizing agent, nucleating agent, epoxy stabilizer, lubricant, antimicrobial agent, flame retardant, antistatic agent, pigment, plasticizer, hydrophylicating agent, etc., maybe added to the thermoplastic resin for use in the second aspect of the invention, not interfering with the effect of the invention.

The cross section of the splittable multi-component fiber of the second aspect of the invention is described.

The splittable multi-component fiber of the second aspect of the invention comprises at least two thermoplastic resin components, for example, as in FIG. 7. In the cross section of the fiber as illustrated, the constituent components are alternately aligned to be adjacent to each other in the direction of the fiber axis, and the cross section of the fiber has a bent, curved or flattened profile. The ratio of the major axis, L, of the cross section of the fiber to the minor axis, W, thereof, L/W falls between 3 and 20. The major axis, L, referred to herein is in the direction in which the constituent components are alternately aligned to be adjacent to each other, and this indicates the length of the longest part of the cross-section profile of the fiber (see FIG. 7). The minor axis, W, is in the direction in which the individual constituent components are contacted with the adjacent ones, and this indicates the thickness of the cross-section profile of the fiber (see FIG. 7). The fiber of which the ratio L/W is larger than 3 can effectively receive high-pressure liquid jets applied thereto. This is because, when compared with ordinary radial or laminated, splittable multi-component fibers having a circular cross-section profile and having the same number of splittable segments and the same fineness as those of the fiber of the invention, the surface area of the fiber of the invention is larger and the contact area between the adjacent constituent components of the fiber is smaller. Accordingly, when high-pressure liquid jets are applied to the fibers under the same pressure, the fiber of the invention can be more readily split than such ordinary fibers. In case where the ratio is larger than 20, the fiber could more effectively receive high-pressure liquid jets applied thereto, but such a large ratio is problematic in that the spinnability of the fiber will be poor, and the productivity of the fiber will be poor since the number of orifices per the unit surface area of the spinneret usable in producing the fiber shall be reduced.

As its cross-section profile is bent, curved or flattened, the splittability of the fiber of the invention is much enhanced. When compared with fibers having a linear cross-section profile (see FIG. 15), the non-drawn fibers of the invention shall be drawn under higher stress in the drawing step where they are gathered between rolls that rotate at different speeds and drawn therebetween. In this stage, the gathered fibers receive higher pressure. In addition, when the fibers are cut into short fibers, the pressure which they receive in the cutting step is comparable to or higher than that in the drawing step. Therefore, in those steps, the splittable multi-component fiber of the invention having such a bent or curved cross-section profile will be more highly crushed than the fiber having a linear cross-section profile, or that is, the former will be partially split. Even if not split, the constituent components of the fiber will be strained at their contact interfaces, and the fiber is thereby in a more readily splittable condition. Accordingly, the splittable multi-component fiber of the second aspect of the invention is more readily splittable.

To the fiber of the type having been partially split in its production process, a technique of wet-laying process is applicable for processing it. In a wet-laying process, the fibers having been partially split are more favorably processed since they can be formed into webs having a tight and uniformity. In case where the fiber is desired to be not so much split in its production process, it is effective to lower the drawing ratio of the fiber. Concretely, it is desirable that the elongation of the drawn fiber is at least 20% of that of the non-drawn fiber. The bent or curved cross-section profile of the fiber of the invention is not specifically defined, including, for example, a C-shaped profile (see FIG. 7 to FIG. 11), an S-shaped profile (see FIG. 13), an M-shaped profile, an N-shaped profile, an L-shaped profile, a V-shaped profile, a W-shaped profile (see FIG. 14), a waved profile, etc.

However, the second aspect of the invention is not whatsoever limited to these cross-section profiles. If desired, different types of profiles may be combined for the cross-section profile of the fiber of the invention.

The flattened cross-section profile for the fiber of the invention includes, for example, a U-shaped profile, a horseshoe-shaped profile, and even a more flattened profile to be derived from such a U-shaped or horseshoe-shaped profile by further compressing its curved area. However, the cross-section profile of the fiber of the invention is not limited to these.

Since the cross section of the splittable multi-component fiber of the second aspect of the invention is bent, curved or flattened in the direction of its major axis, as so mentioned hereinabove, the fiber can enjoy the intended effect also in a calendering step where it is pressed against a pair of calender rolls, like in the drawing or cutting step. Therefore, even when non-drawn long fibers of the invention are directly bonded on a conveyor, for example, according to a spun-bonding method where they are passed through a pair of calender rolls under pressure , they can be formed into bonded articles of split fine fibers. Different from conventional, splittable multi-component fibers for ordinary spun-bonding, the constituent segments of the splittable multi-component fiber of the second aspect of the invention all have nearly the same fineness. Therefore, the fibers of the invention can be formed into bonded articles of fine fibers having a more uniform fineness.

In the splittable multi-component fiber of the second aspect of the invention, preferably, the ratio of the outer peripheral length, a, of one constituent component to the contact length, b, thereof to the adjacent component, a/b, in the cross section falls between 0.1 and 2.5. If the ratio a/b is smaller than 0.1, the contact area between the adjacent constituent components will be too large, as compared with the outer peripheral surface of the fiber. If so, the fiber will have a laminate structure of thin layers, and will therefore require increased energy to attain a high split ratio of segment split. On the other hand, if the ratio is larger than 2.5, the number of segments constituting the fiber will be small or the thickness of the flattened cross-section profile of the fiber will be small. If so, the fiber will be extremely difficult to produce at high spinnability.

Also preferably, in the cross section of the splittable multi-component fiber of the second aspect of the invention, the ratio of the area, S1, surrounded by the bent or curved constituent components to the cross-sectional area, S2, of the fiber, S1/S2 (see FIG. 12) falls between 0.2 and 1.0. S1 represents the area of the part surrounded by the bent or curved constituent components and the line that connects the both ends of the major axis of the cross section, indicating the degree of bending or curvature of the cross-section profile of the fiber. Concretely, a larger value S1 means that the major axis of the cross section of the fiber is bent or curved to a higher degree. It is desirable that S1/S2 is at least 0.2. If it is smaller than 0.2, the cross-section profile of the fiber will be bent or curved only a little, and the effect resulting from the bent or curved profile will be small. If, however, the ratio is larger than 1.0, the major axis of the cross section of the fiber will be too long, or the fiber will be too thin. If so, the productivity of the fiber will be poor.

As having the specific cross-section profile noted above, the splittable multi-component fiber of the second aspect of the invention is well splittable and can be readily split into fine fibers even when it comprises a combination of different polyolefin resins of the same type. As opposed to it, conventional splittable multi-component fibers comprising a combination of a plurality of resins of the same type are extremely difficult to split into fine fibers and requires high energy for their split. In addition, even in webs of short fibers of the type of the invention produced according to a wet-laying process, the constituent short fibers can be efficiently split into fine fibers and the resulting webs can have uniformity. Because of these reasons, the splittable multi-component fiber of the second aspect of the invention is favorable to the combination of different resins of the same type which has heretofore been difficult to split into individual constituent segments. The spinneret to be used for ensuring the specific cross-section profile of the splittable multi-component fiber of the second aspect of the invention is not specifically defined, so far as the splittable multi-component fiber can be produced through it. For example, the orifices of the spinneret for use in the invention will be aligned to form a C-shaped, S-shaped, M-shaped, N-shaped, L-shaped, V-shaped, W-shaped, waved, U-shaped or horseshoe-shaped profile.

In the splittable multi-component fiber of the second aspect of the invention, the blend ratio of at least two constituent, thermoplastic resin components preferably falls between 10/90 and 90/10% by weight, with the total of all the constituent resins being 100% by weight, more preferably between 30/70 and 70/30% by weight, most preferably between 40/60 and 60/40% by weight. With the blend ratio thereof falling within the defined range, at least two constituent thermoplastic resin components can be uniformly aligned to have an well-aligned cross-section profile, and the fibers having such an well-aligned cross-section profile can form more uniform articles.

In case where the splittable multi-component fiber of the second aspect of the invention is split into fine fibers by high-pressure liquid jets applied thereto, the mean fineness of the split fine fibers is preferably at most 0.5 dtex, more preferably at most 0.3 dtex. Accordingly, the number of splittable segments of the fiber will be so determined that the mean fineness of the split fine fibers could be at most 0.5 dtex. A larger number of splittable segments of the fiber will produce an advantage that the fineness of the split fine fibers is smaller. In practice, however, it is desirable that the number of the splittable segments of the fiber falls between 4 and 32 in view of the easiness in producing the fiber.

The single fiber fineness of the splittable multi-component fiber is not specifically defined, but preferably falls between 0.5 and 10.0 dtex, more preferably between 1.0 and 6.0 dtex. It is not always necessary that the individual segments constituting the fiber have the same fineness. In case where the splittable multi-component fiber could not be completely split. after processed for fiber split, it may include at random a non-split fiber moiety, a completely-split fine fibers, and a plurality of other fiber moieties each having a different fineness.

One embodiment of producing the splittable multi-component fiber of the second aspect of the invention is described. This is to demonstrate the production of the splittable multi-component fiber that comprises a combination of two components, polypropylene resin and high-density polyethylene resin.

Long fibers comprising the resins are spun by the use of an ordinary melt-spinning machine. The spinning temperature preferably falls between 200 and 330° C., and the take-up speed preferably falls between 40 m/min and 1500 m/min or so. If desired, the spun fibers may be drawn. In case where the spun fibers are drawn, the drawing ratio will fall generally between 3 and 9 times the original length, or so. The resulting tows are cut into short fibers having a predetermined length. This process is for producing short fibers. Apart from this, the long tows produced may be, without being cut into short fibers, passed through a dividing guide into webs. If desired, the resulting short fibers or webs may be further processed and worked into fibrous articles for various applications. After having been spun and drawn, filaments of the resulting fibers are wound up, and these may be woven or kneaded into woven or knitted fibrous articles; or the short fibers are processed into weaving or knitting yarns, and these may be woven or knitted into woven or knitted fibrous articles.

The fibrous articles referred to herein are meant to indicate all types of fabric-like articles, including, for example, woven fabrics, knitted fabrics, non-woven fabrics, etc. They may be produced by any method of mixing, blending or combining different types of fibers, or even twisting, weaving or combining union fibers or filaments.

In the process of producing such fibrous articles, a surfactant may be applied to the spun fibers, which is for preventing the fibers from being statically charged, for improving the workability of the fibers into fibrous articles and for leveling the fibers. The type and the concentration of the surfactant will be appropriately selected and controlled depending on the use of the fibers. For applying such a surfactant to the fibers, for example, employable is a roller method, a dipping method or a patting and drying method. The surfactant may be applied to the fibers in any stage of spinning, drawing or crimping the fibers. Irrespective of short fibers or long fibers, the surfactant may be applied thereto in any stage other than the stage of spinning, drawing or crimping the fibers. For example, it may be applied to final fibrous products.

Polyolefin resin for the splittable polyolefin multi-component fiber of the third and fourth aspects of the invention includes, for example, homopolymers of aliphatic α-olefins having from 2 to 8 carbon atoms, such as ethylene, propylene, 1-butene, 1-pentene, 4-methyl-1-pentene, 3-methyl-1-butene, 1-hexene, 1-octene, etc., or copolymers of at least two different types of these α-olefins; copolymers of such α-olefins with any other olefins and/or other minor, ethylenic unsaturated monomers such as butadiene, isoprene, pentadiene-1,3, styrene, α-methylstyrene, polyvinyl alcohol, polyvinyl acetate, polyacrylates, etc., and also mixtures of two or more of these. Stereospecific polystyrene resin is also within the scope of the polyolefin resin for the fiber. Stereospecific polystyrene resin can be identified by its tacticity in $^{13}$C-NMR, concretely by the fractional proportion of a plurality of constituent units directly connected in series therein, for example, by the diad fraction, the triad fraction or the pentad fraction of two, three or five constituent units directly connected in series therein, respectively. The stereo-specific polystyrene resin for use in the invention will generally have syndiotacticity of at least 85%, but preferably at least 95%, in terms of the racemi-pentad fraction therein. The racemi-pentad fraction of the polymer can be derived from the absorption peak area seen at 145.35 ppm and indicating the syndiotactic structure of the polymer in $^{13}$C-NMR. It includes, for example, polystyrene; polyalkylstyrenes such as polymethylstyrene, polyethylstyrene, polyisopropylstyrene, etc.; polyhalogenostyrenes such as polychlorostyrene, polybromostyrene, polyfluorostyrene, etc.; polyhalogenoalkylstyrenes such as polychloromethylstyrene, etc.; polyalkoxystyrenes such as polymethoxystyrene, polyethoxystyrene, etc.; polystyrene benzoates, etc. Needless-to-say, one or more of these polymers may be used herein either singly or as combined. In addition, copolymers of only the monomers for these polymers, and also copolymers essentially comprising the monomers are also usable herein.

Concretely, the copolymers will be formed from at least one monomer selected from the monomer group mentioned above and a comonomer selected from olefin monomers such as ethylene, propylene, butene, hexene, heptene, octene, decene, etc.; diene monomers such as butadiene, isoprene, etc.; cyclic olefin monomers, cyclic diene monomers; or polar vinyl monomers such as methyl methacrylate, maleic anhydride, acrylonitrile, etc., and have a syndiotactic styrene structure. These homopolymers and copolymers are available on the market, and any commercial products are usable herein.

Typically mentioned for these are polypropylene resin and polyethylene resin. The polypropylene resin includes, for example, propylene homopolymers, copolymers of propylene and at least one of α-olefins except propylene such as those mentioned above, of which the propylene content is at least 70% by weight, for example, ethylene-propylene copolymers, ethylene-propylene-butene copolymers, etc.

The polyethylene resin includes, for example, high-densitypolyethylene (HDPE), low-density polyethylene (LDPE) linear low-density polyethylene (LLDPE), etc. Especially preferred is high-density polyethylene.

The melt flow rate (MFR) of the polyolefin resin, typically the polypropylene resin and the polyethylene resin for use herein is not specifically defined, so far as it falls within a range within which the resin is spinnable. Preferably, MFR of the resin falls between 1 and 100 g/10 min, more preferably between 5 and 70 g/10 min.

For the splittable polyolefin multi-component fiber of the third and fourth aspects of the invention, at least two polyolefin resins mentioned above may be combined in any desired manner. For industrial materials and sanitary materials which are required to be resistant to chemicals, more preferred is an inexpensive combination of polypropylene resin and polyethylene resin.

The polyolefin resins may be combined in any desired manner for the fiber of the invention. However, a combination of resins that are just the same, for example, a combination of polypropylene resin and polypropylene resin, and a combination of mixtures having the same constitutional ratio shall be excluded from the scope of the invention.

In the preferred combination of two components, polypropylene resin and polyethylene resin, for the splittable polyolefin multi-component fiber of the third and fourth aspects of the invention, the polypropylene resin is the high-melting-point resin, component A. Concretely, the polypropylene resin includes syndiotactic polypropylene and isotactic polypropylene produced through polymerization in the presence of, for example, a Ziegler-Natta catalyst or a metallocene catalyst. The high-melting-point polypropylene resin is acceptable herein so far as its MFR-A falls within a range within which the resin is spinnable in melt. Concretely, the resin, if so controlled that its fibers could have MFR-A falling within a range of from 10 to 100 g/10 min, for example, by changing the spinning condition for it, involves no specific problem. More preferably, the resin has, after having formed fibers, MFR-A falling between 10 and 70 g/10 min. If it has, after having formed fibers, MFR-A lower than 10 g/10 min, the resin will be difficult to well spin into fine fibers though the spun fibers from it could have a high degree of hollowness. On the other hand, if it has, after having formed fibers, MFR-A higher than 100 g/10 min, its fibers could hardly ensure a high degree of hollowness, and, in addition, it could not be well spun into good filaments.

In the combination, the polyethylene resin is the low-melting-point resin, component B, of which the melting point is lower than that of the above-mentioned polypropylene resin. Concretely, it includes high-density polyethylene (HDPE), linear low-density polyethylene (LLDPE), and low-density polyethylene (LDPE). A mixture of two or more of such polyethylenes may also be the low-melting-point resin component. The starting polyethylene resin is acceptable herein so far as its MFR-B falls within a range within which the resin is spinnable in melt. Concretely, the resin, if so controlled that its fibers could have MFR-B falling within a range of from 10 to 100 g/10 min, for example, by changing the spinning condition for it, involves no specific problem. More preferably, the resin has, after having formed fibers, MFR-B falling between 10 and 60 g/10 min. If it has, after having formed fibers, MFR-B lower than 10 g/10 min, the resin will be extremely difficult to well spin into good fine fibers though the spun fibers from it could have a high degree of hollowness. On the other hand, if it has, after having formed fibers, MFR-B higher than 100 g/10 min, its fibers could hardly ensure a high degree of hollowness, and, in addition, it could not be well spun into good filaments.

Preferably, the splittable polyolefin multi-component fiber that comprises at least two polyolefin resin components is such that the ratio of the melt flow rate, MFR-A, of the constituent resin component (A) having the highest melting point of all to the melt flow rate, MFR-B, of the constituent resin component (B) having the lowest melting point of all, MFR-A/MFR-B falls between 0.1 and 5, more preferably between 0.5 and 3. If the ratio is smaller than 0.1 or larger than 5, the resin mixture for the fiber could hardly be spun into fibers having a high degree of hollowness. This is because, if so, the difference between the two resins in the fluidity through spinnerets through which they are melt-spun into fibers, the melt tension of the hollow fibers spun from the resin mixture, and even the viscosity increase in cooling the spun fibers will be great.

If desired, additives such as antioxidant, light stabilizer, UV absorbent, neutralizing agent, nucleating agent, epoxy stabilizer, lubricant, antimicrobial agent, flame retardant, antistatic agent, pigment, plasticizer, hydrophylicating agent, etc., may be added to the polyolefin resin for use in the third and fourth aspects of the invention, not interfering with the effect of the invention.

The structure of the splittable polyolefin multi-component fiber of the third and fourth aspects of the invention is not specifically defined, so far as the fiber is a hollow fiber and is splittable into constituent segments by high-pressure liquid jets applied thereto. One example of the fiber comprising two polyolefin resin components (A) and (B) is shown in FIG. 17, in which the components (A) and (B) are alternately aligned as in the illustrated cross section of the fiber. In case where the fiber comprises three or more polyolefin resin components, it is desirable that the constituent components are also alternately aligned to give a cross-section profile similar to the illustrated profile.

In case where the splittable polyolefin multi-component fiber is split into fine fibers by high-pressure liquid jets applied thereto, the mean single-fiber fineness of the split fine fibers is preferably smaller than 0.6 dtex, more preferably at most 0.5 dtex, even more preferably at most 0.3 dtex. Accordingly, the number of splittable segments of the hollow, splittable multi-component fiber will be so determined that the mean fineness of the split fine fibers could be smaller than 0.6 dtex, preferably at most 0.5 dtex. A larger number of splittable segments of the fiber will produce an advantage that the fineness of the split fine fibers is smaller. In practice, however, it is desirable that the number of the splittable segments of the fiber falls between 4 and 32 in view of the easiness in producing the fiber. It is not always necessary that the individual segments constituting the fiber have the same fineness. In case where the splittable multi-component fiber could not be completely split after processed for fiber split, it may include at random a non-split fiber moiety, a completely-split fine fibers, and a plurality of other fiber moieties each having a different fineness.

The cross section of the splittable polyolefin multi-component fiber of the third aspect of the invention is described.

The splittable polyolefin multi-component fiber of the third aspect of the invention comprises at least two polyolefin resin components (A) and (B) which are radially alternately aligned around its center hollow. In its cross section, the ratio of the mean length, W, of the outer peripheral arc of one constituent resin component to the mean thickness, L, of the component between the end of the hollow and the outer periphery of the fiber, W/L, must fall between 0.25 and 2.5. If W/L is smaller than 0.25, the constituent segments of the fiber will be too thin. If so, therefore, the fiber will have a laminate structure of thin layers, and will therefore require increased energy, for segment split. In other words, the contact area of the components (A) and (B) increases, and the components in that condition are not easy to split. On the other hand, if the ratio is larger than 2.5, the number of segments constituting the fiber will be small or the degree of hollowness of the fiber will be too large. If so, the fiber could not ensure good spinnability, and the single fiber fineness of the split fine fibers from it could not be reduced to a desired degree. This is outside the spirit of the invention to provide multi-component fibers capable of being readily split in-to fine fibers.

Preferably, the cross-section profile of the hollow of the splittable polyolefin multi-component fiber of the third aspect of the invention is so configured that it has at least one curve of which the radius of curvature ($\rho$) is smaller than the radius (r) of the circle having the same area as the cross-sectional area of the hollow. This means that the cross section of the hollow of the fiber is not in the form of a complete circle but is partially deformed. With the hollow configuration, some of the alternately aligned segments of the fiber are thinner than some others thereof, and the thinner part of the fiber is readily peeled off by physical stress applied thereto, and therefore the fiber is readily split into the constituent segments. After any one part of the hollow, splittable multi-component fiber is once peeled and split, the hollow of the fiber will be then deformed to have a horseshoe-shaped cross section. The fiber of which the hollow has been thus deformed could more readily receive physical stress of high-pressure liquid jets applied thereto, and could therefore be more readily split into fine fibers. Specifically, the cross-section profile of the center hollow of the fiber is not in the form of a complete circle, but is partially deformed to be an irregularly modified cross-section profile. With the hollow having the thus-modified cross-section profile, the fiber is basically unstable to shock. As a result, the fiber is readily split into fine fibers even by lower impact energy applied thereto. The radius of curvature ($\rho$) of the cross section of the hollow of the fiber is not specifically defined, so far as it is smaller than the radius (r) of the circle having the same area as the cross-sectional area of the hollow. This is because, with its cross section having such a smaller radius of curvature, the hollow of the fiber is favorably deformed. However, in case where the radius of curvature ($\rho$) of the cross section of the hollow is near to the radius (r) of the circle corresponding to the cross-sectional area of the hollow, the cross section of the hollow will be nearly circular and the effect of the hollow to facilitate easy fiber split will be reduced. More preferably, therefore, $\rho<0.8r$, most preferably, $\rho<0.7r$.

The cross section of the splittable multi-component fiber of the fourth aspect of the invention is described.

The splittable multi-component fiber of the fourth aspect of the invention comprises at least two polyolefin resin components which are alternately aligned around its center hollow, and its cross section is deformed and flattened. In addition, the fiber is so constituted that at least one constituent component is partially peeled off. Preferably, the fiber is so constituted that it ensures nearly the same effect anytime when it receives external stress at any site of its surface. For example, for this, it is desirable that the constituent segments of the fiber are radially aligned around its center hollow. Also preferably, a part of the splittable constituent segments are at least exposed outside the outer periphery of the fiber for ensuring easy fiber split.

Deforming the cross-section profile of the multi-component fiber flattened means that the fiber is, after spun or drawn, deformed by applying some external stress to its outer peripheral surface and is thereby flattened. In that manner, the cross section of the multi-component fiber that comprises polyolefin resin segments alternately aligned around its center hollow is deformed to have a flattened cross-section profile. The means for applying external stress to the fiber for flattening it is not specifically defined. For example, for flattening the fiber, employable is a method of deforming the fiber by pressing it between a pair of rolls while it runs and passes through them (method A); a method of deforming the fiber by applying a roll or a pillar object thereto while it runs, whereby the running fiber is rubbed against the surface of the roll or the edge of the pillar object (method B); a method of deforming the fiber by passing it through a slit that is gradually tapered thin in the fiber running direction so that the fiber can narrowly pass through the tapered slit under pressure (method C); a method of deforming the gathered fibers by twisting them under tensile tension (method D); and a combination of any of these methods. After the external stress has been applied to the fiber in the manner as above, the fiber may be cut with a roller cutter, a guillotine cutter or the like into short fibers having a predetermined length. In this stage, the cut face of the fiber shall receive physical stress, whereby the contact interfaces of the constituent segments of the thus-cut fibers could be more readily splittable. It is important that, while the cross-section profile of the multi-component fiber is deformed and flattened according to any of such various methods, a part of the contact interfaces between adjacent two segments of the fiber are peeled off at the same time.

The degree of deformation (minor axis W/major axis L) of the cross section of the splittable polyolefin multi-component fiber of the fourth aspect of the invention falls between 0.2 and 0.9, preferably between 0.2 and 0.8, more preferably between 0.3 and 0.8. The degree of deformation referred to herein is represented by a ratio, minor axis W/major axis L, in which the major axis L indicates the length of the longest part of the outer periphery of the multi-component fiber in the cross section, and the minor axis W is perpendicular to the major axis, indicating the length of the shortest part of the outer periphery of the fiber in the cross section. In case where the degree of deformation is smaller than 0.2, the hollow of the fiber is completely flattened and even the cross section of each constituent segment is also deformed and flattened. When the fibers of the type are processed for segment split into fine fibers and are formed into fibrous articles (e.g., non-woven fabrics), then the strength of the fibrous articles is extremely low. On the other hand, in case where the degree of deformation is larger than 0.9, the external stress from roll pressure or the like to the fiber is weak and is therefore not enough to significantly deform the fiber and enhance the interfacial splittability of the constituent segments of the fiber.

In the cross section of the splittable polyolefin multi-component fiber of the fourth aspect of the invention, at least a part of the constituent components are peeled off to facilitate easier fiber split. Preferably, the constituent components of the fiber are peeled off to a degree of at least 10% of their contact interfaces in the cross section of the fiber. The contact interfaces of the constituent segments of the multi-component fiber depend on the number of the splittable segments of the fiber. In the fiber, some segment contact interfaces may be partially or completely peeled off. Anyhow, at least 10% of all segment contact interfaces in the fiber shall be peeled off. In case where the percentage of the peeled area therein is smaller than 10%, the fiber, though splittable in some degree, could not be split to a high degree when processed with low-pressure liquid jets. On the other hand, in case where at least 10% of the segment contact interfaces are peeled off in the fiber, the interfaces around the peeled interfaces can surely receive external physical stress applied to the fiber, and, though not peeled, they are surely strained to facilitate easy fiber split by the action of lower energy applied thereto.

In the cross section of the splittable polyolefin multi-component fiber of the third and fourth aspect of the invention, the area of the center hollow, or that is, the degree of hollowness preferably falls between 5% and 40%, more preferably between 10 and 30%. In case where the degree of hollowness is smaller than 5%, the value L is large and the contact area of the adjacent segments is large. If so, the non-split fiber is difficult to crush when it is split into fine fibers by applying physical stress thereto, and the energy necessary for peeling the contact interface between the components (A) and (B) shall increase. On the other hand, in case where the degree of hollowness is larger than 40%, the value L is small and the contact area of the adjacent segments is small. If so, splitting the fiber into fine fibers or deforming and flattening it by applying physical stress to the fiber will be easy, but it is difficult to efficiently produce the non-split fiber at high productivity while the fiber being produced is well kept spinning. Accordingly, the degree of hollowness preferably falls between 5% and 40%, more preferably between 10 and 30%. With the degree of hollowness defined to fall within the range, the fiber being produced is well kept spinning while its productivity is kept high, and the fiber produced can be split into fine fibers with ease. The hollow is not limited to the center part of the fiber. In case where a foaming agent is added to any one of the components (A) and (B), the spun fiber of the components (A) and (B) thus containing such a foaming agent could have fine pores in any of the segments of the components (A) and (B). In the fiber, the fine pores will exist in the boundaries of the components (A) and (B) to thereby reduce the contact area between the adjacent components. Accordingly, the impact energy to be applied to the fiber for splitting it could be reduced, and the splittability of the fiber is further enhanced. The foaming agent usable for that purpose includes, for example, azodicarbonamide, barium azodicarboxylate, N,N-dinitrosopentamethylenetetramine, p-toluenesulfonyl-semicarbazide, trihydrazinotriazine, etc. The outer periphery of the cross section of the fiber may have a circular profile or may have an oval or any other irregular cross-section profile of angular forms such as triangular to octagonal forms, etc.

In the splittable polyolefin multi-component fiber of the third and fourth aspects of the invention, the blend ratio of at least two constituent, polyolefin resin components preferably falls between 10/90 and 90/10% by weight, with the total of all the constituent resins being 100% by weight, more preferably between 30/70 and 70/30% by weight. Most preferably, the fiber is composed of two polyolefin resin components with the blend ratio thereof being 50/50% by weight. With the blend ratio thereof falling within the defined range, at least two constituent polyolefin resin components can be uniformly aligned to have an well-aligned cross-section profile. When split, the fibers give fine fibers having a constant fineness, and can therefore form bonded fibrous articles having more uniformity.

Before being split, the single fiber fineness of the splittable polyolefin multi-component fiber of the third and fourth aspects of the invention is not specifically defined, but preferably falls between 0.6 and 10.0 dtex, more preferably between 1.0 and 6.0 dtex. If its single fiber fineness is smaller than 0.6 dtex, the spinning property of the fiber in the step of melt-spinning it will be poor. On the other hand, if its single fiber fineness is larger than 10.0 dtex, the fiber could not be well split into fine fibers, and, when a web comprising the fibers is processed with high-pressure liquid jets or the like, it could not be formed into a highly uniform fibrous article.

Preferably, the mean single fiber fineness of the fine fibers split from the multi-component fiber is not larger than 0.6 dtex, more preferably at most 0.5 dtex. If their mean single fiber fineness is not smaller than 0.6 dtex, the split fine fibers will lose the most significant characteristic to give uniform fibrous articles having softness and uniformity.

Hereinunder described is a method for producing one example of the splittable polyolefin multi-component fiber of the third aspect of the invention that comprises a combination of two components, polypropylene resin and high-density polyethylene resin.

Long fibers comprising the resins are spun by the use of an ordinary melt-spinning machine. The spinning temperature preferably falls between 200 and 330° C., and the take-up speed preferably falls between 40 m/min and 1500 m/min or so. If desired, the spun fibers may be drawn in a mode of multi-stage drawing. The drawing ratio will fall generally between 3 and 9 times the original length, or so. Optionally after having been crimped, the resulting tows may be cut into short fibers having a predetermined length. This process is for producing short fibers. Apart from this, the long tows produced may be, without being cut into short fibers, passed through a dividing guide into webs. If desired, the resulting short fibers or webs may be further processed and worked into fibrous articles for various applications.

After having been spun and drawn, filaments of the resulting fibers are wound up, and these may be woven or kneaded into woven or knitted fibrous articles; or the short fibers are processed into weaving or knitting yarns, and these may be woven or knitted into woven or knitted fibrous articles.

The fibrous articles referred to herein are meant to indicate all types of fabric-like articles, including, for example, woven fabrics, knitted fabrics, non-woven fabrics, etc. They may be produced by any method of mixing, blending or combining different types of fibers, or even twisting, weaving or combining union fibers or filaments.

In the process of producing such fibrous articles, a surfactant may be applied to the spun fibers, which is for preventing the fibers from being statically charged, for improving the workability of the fibers into fibrous articles and for leveling the fibers. The type and the concentration of the surfactant will be appropriately selected and controlled depending on the use of the fibers. For applying such a surfactant to the fibers, for example, employable is a roller method, a dipping method or a patting and drying method. The surfactant may be applied to the fibers in any stage of spinning, drawing or crimping the fibers. Irrespective of short fibers or long fibers, the surfactant may be applied thereto in any stage other than the stage of spinning, drawing or crimping the fibers. For example, it may be applied to final fibrous products.

The length of the splittable polyolefin multi-component fiber is not specifically defined. For example, in case where webs are produced by the use of a carding machine, the fibers for them will generally have a length falling between 20 and 76 mm. On the other hand, in case where they are produced in a wet-laying process or in an air-laying process, the fibers for them will preferably have a length falling between 2 and 20 mm. However, fibers shorter than 2 mm will move when physical impact is applied thereto, and they can hardly receive the energy necessary for their split. Fibers far longer than 76 mm could not be stably formed into uniform webs in a carding machine or the like, and the webs from them will be rough.

One embodiment of producing a fibrous article that comprises splittable polyolefin multi-component fibers of the third and fourth aspects of the invention is described. This is for producing a non-woven fabric. Splittable polyolefin, multi-component short fibers of the invention produced, for example, in the method mentioned above are formed into a web having a predetermined Metsuke (weight), according to a carding method, an air-laying method or a wet-laying method. If desired, the web may be directly formed according to a melt-blowing method, spun-bond method or the like. In the web thus produced, the constituent fibers are split into fine fibers in any known method of, for example, needle-punching the web or processing it with high-pressure liquid jets. From the web thus processed, produced is the intended fibrous article, non-woven fabric. If desired, the fibrous article may be further processed with hot air, hot rolls or the like in any known manner. In case where a web produced from extremely short fibers in a wet-laying process or the like is processed in such a known method of, for example, needle-punching it or applying high-pressure liquid jets thereto so as to split the constituent fibers into fine fibers, the constituent fibers being split by the physical stress applied thereto will move to worsen uniformity of the web. To evade the problem, for example, some other fibers capable of melting at a temperature lower than the melting point of the resin that constitutes the splittable multi-component fibers will be blended with the multi-component fibers before the fibers are formed into a web. In the web, the multi-component fibers will be stabilized by the low-melting-point fibers having melted therearound, and the non-woven fabric from the web could have uniformity.

The Metsuke (weight) of the fibrous article is not specifically defined, but preferably falls between 10 and 200 $g/m^2$. Non-woven fabrics having a weight of smaller than 10 $g/m^2$ will have unniformity, when they are produced by splitting the constituent fibers into fine fibers by the action of physical stress in treatment with high-pressure liquid jets, etc. For non-woven fabrics having a weight of larger than 200 $g/m^2$, the pressure of the liquid jets to be applied to the webs for splitting the multi-component fibers into fine fibers will have to be increased since the weight of the webs to be the non-woven fabrics is too high, and the multi-component fibers in the webs will be roughly split into fine fibers. As a result, it will be difficult to obtain uniform non-woven fabrics.

In producing the fibrous articles, if desired, the splittable multi-component fibers of the invention may be blended with any other fibers not interfering with the invention. For the additional fibers, usable are synthetic fibers of polyamides, polyesters, polyolefins, acrylic resins, etc.; natural fibers of cotton, wool, hemp, etc.; regenerated fibers of rayon, cupra, acetate, etc.; semi-synthetic fibers, etc.

The shape of the splittable polyolefin multi-component fiber of the fourth aspect of the invention is not specifically defined, so far as it has a center hollow and its cross section is so deformed that the outer periphery and/or the inner periphery thereof could have a modified cross-section profile. The outer periphery and the inner periphery of the cross section of the multi-component fiber may have a circular or irregular cross-section profile. The irregular cross-section profile includes a flattened profile and a polygonal profile of, for example, triangles to octagons, etc. Some examples of the cross-section profile of the multi-component fiber that comprises two polyolefin resin components (A) and (B) are in FIG. 21 to FIG. 32, in which the components (A) and (B) are alternately aligned in the cross section of the fiber illustrated. In case where the splittable multi-component fiber comprises three or more polyolefin resin components, it is desirable that the constituent components are also alternately aligned in its cross section.

Hereinunder described is a method for producing one example of the splittable multi-component fiber of the fourth aspect of the invention that comprises a combination of two components, polypropylene resin and high-density polyethylene resin.

Long fibers comprising the resins are spun by the use of an ordinary melt-spinning machine. The spinning temperature preferably falls between 200 and 330° C., and the take-up speed preferably falls between 40 m/min and 1500 m/min or so. If desired, the spun fibers may be drawn in a mode of multi-stage drawing. The drawing ratio will fall generally between 3 and 9 times the original length, or so. In the method (A) for deforming and flattening the multi-component fiber, the roll-to-roll pressure may fall between 1 kg/cm and 50 kg/cm. Under the pressure falling within the range, the drawn fiber is flattened and the contact interfaces of the segments constituting it are peeled or strained to give the splittable polyolefin multi-component fiber of the invention. If desired, the fiber may be cut into short fibers having a predetermined length. Also if desired, the resulting tows may be crimped.

The rolls for deforming and flattening the multi-component fiber arer not specifically defined, including, for example, a combination of a metal roll and a metal roll, a combination of a metal roll and a rubber roll, and a combination of a rubber roll and a rubber roll. The role surface may be flat or roughened. The configuration of the roughened roll surface includes, for example, linear or waved ridges formed in the direction perpendicular to the rotating direction of the roll. Preferred for use in the invention are combinations of metal rolls both having a flat surface, and a combination of a metal roll having a flat surface and a metal roll having a roughened surface. The fiber may be deformed under pressure in any stage of the spinning and drawing step of producing the fiber. Preferably, however, the fiber is deformed after the drawing step but before the cutting step. Briefly, after having been drawn, the fiber is deformed by pressing it between a pair of rolls as above, and then cut into short fibers having a predetermined length. This is because the drawn fiber is crystallized to the highest degree and is therefore most stiff in the process of producing the intended multi-component fiber. Accordingly, the drawn fiber in that condition can be well deformed and flattened by pressing it between rolls, and the contact interfaces of the segments constituting it are well strained. Deforming the drawn fiber may be effected in any ordinary equipment, not requiring any additional pressure roll unit. The drawn fiber may be deformed by crimper rolls in the crimper unit in ordinary equipment.

The process mentioned above is for producing short fibers. Apart from this, the long tows produced may be, without being cut into short fibers, passed through a dividing guide into webs. If desired, the resulting short fibers or webs may be further processed and worked into fibrous articles for various applications. After having been spun and drawn, filaments of the resulting fibers are wound up, and these may be woven or kneaded into woven or knitted fibrous articles; or the short fibers are processed into weaving or knitting yarns, and these may be woven or knitted into woven or knitted fibrous articles.

The fibrous articles referred to herein include for example, woven fabrics, knitted fabrics, non-woven fabrics, etc. The fibrous articles may also be in any form of laminates of such woven fabrics, knitted fabrics, non-woven fabrics, spunbonded fabrics and others, and even rods and packed articles of such fabrics.

In the process of producing such fibrous articles, a surfactant may be applied to the spun fibers, which is for preventing the fibers from being statically charged, for improving the workability of the fibers into fibrous articles, for enhancing the dispersibility of the constituent components in producing the fibers in a wet-laying process, and for leveling the fibers. The type and the concentration of the surfactant will be appropriately selected and controlled depending on the use of the fibers. For applying such a surfactant to the fibers, for example, employable is a roller method, a dipping method, etc. The surfactant may be applied to the fibers in any stage of spinning, drawing or crimping the fibers. Irrespective of short fibers or long fibers, the surfactant may be applied thereto in any stage other than the stage of spinning, drawing or crimping the fibers. For example, it may be applied to final fibrous products.

Treatment of splittable multi-component fibers with high-pressure liquid jets for fiber split is described. For the treatment, for example, used is a high-pressure liquid jet apparatus that comprises a nozzle plate having a plurality of nozzles of from 0.05 to 1.5 mm, preferably from 0.1 to 0.5 mm in diameter, aligned in one line or in a plurality of lines at a pitch of from 0.1 to 1.5 mm. Through the nozzles, water jets are jetted out under a pressure of from 0.98 to 29.4 MPa, preferably from 4.9 to 24.5 MPa, onto webs put on a porous support. Having received such high-pressure liquid jets from the apparatus, the splittable multi-component fibers of the invention are entangled and split into fine fibers. On the nozzle plate, the nozzles are aligned in one or more lines perpendicular to the running direction of the webs to be processed with high-pressure liquid jets through them. For the high-pressure liquid jets, usable is room-temperature water or warm water. Also usable are any other liquids.

The distance between the tip of each nozzle and the web being treated is preferably from 10 to 150 mm. If the distance is shorter than 10 mm, the uniformity of the processed fibrous article will be disordered; but if longer than 150 mm, the physical impact of the liquid jets to the web will be weak, and the fibers constituting the web could not be well entangled and split into fine fibers. Though depending on the Metsuke (weight) of the web to be treated, the pressure of the liquid jets may be gradually increased within the pressure range as above in the running direction of the web being treated. In that manner, the fibers constituting the web are well entangled and split into fine fibers and the uniformity of the processed web is not disordered.

The porous support on which the web to be treated with such high-pressure liquid jets is mounted is not specifically defined, so far as the high-pressure liquid jets having been applied to the web thereon can pass through it. For example, it may be a 50 to 200-mesh screen of metal gauze or synthetic resin, or may be any other porous plate. After one surface of a web has been treated with high-pressure liquid jets, the web may be turned backside out and is again treated with high-pressure liquid jets. In that manner, both surfaces of the web are well treated with the liquid jets to have tight uniformity, and the resulting fibrous article of the thus-processed web can have uniformity. After having been thus treated with such high-pressure liquid jets, the resulting fibrous article is dewatered. For removing water from it, any known method is employable. For example, the processed fibrous article is squeezed by the use of a mangling device or the like to remove water in some degree, and then dried in a drying device such as a hot air-circulating drier or the like to completely remove water from it. The thus-dried fibrous article is one embodiment of the fibrous article of the invention.

The thus-produced fibrous article of the first to fourth aspects of the invention comprises fully split fine fibers, and therefore has a soft and tight uniformity favorable for wipers.

EXAMPLES

The invention is described in more detail with reference to the following Examples and Comparative Examples, which, however, are not whatsoever intended to restrict the scope of the invention. In the Examples and Comparative Examples, the fibers and the non-woven fabrics produced were tested and evaluated for their properties according to the methods mentioned below.

(1) Spinnability (1):

While a resin sample is spun into fibers, the number of fiber cuts in one hour is counted. Based on the data, the spinnability of the resin sample is evaluated.

○: Fibers not cut.

Δ: Fibers cut once to three times.

×: Fibers cut 4 or more times.

(2) Melt Flow Rate (MFR) of Resin:

Measured according to JIS K7210. Original polypropylene resin: Condition 14. Original polyethylene resin: Condition 4. Polyethylene resin fibers: Condition 14.

(3) Melting Point:

Using a Parkin Elmer's differential scanning calorimeter, DSC7 Model, a resin sample is heated up to 230° C. at a heating rate of 10° C./min, kept at the temperature for 10 minutes, then cooled to −20° C. at a cooling rate of −20° C./min, kept at the temperature for 10 minutes, and thereafter again heated at a heating rate of 10° C./min. In last step of the heat cycle, the peak temperature at which the sample is melted is read, and this indicates the melting point of the sample.

(4) Cross-section Profile of Fiber:

A fiber sample is embedded in wax. Using a microtome, this is cut at random but all in the direction almost perpendicular to thee fiber axis. Ten cut faces of the sample pieces are observed and analyzed by the use of a microscope.

(5) Split Ratio:

A sample to be analyzed is embedded in wax. Using a microtome, this is cut at random but all in the direction almost perpendicular to the fiber axis. The cut face of each sample piece is observed with a microscope, and its microscopic picture is analyzed by image processing to obtain the overall cross section (A) of the split ultra-fine fibers and the overall cross section (B) of the non-split original fiber. The split ratio is represented by the following equation:

$$\text{Split ratio } (\%) = A/(A+B) \times 100.$$

Ten pieces are cut out at random from one sample and analyzed in the manner as above. The data of the ten pieces are averaged to be the split ratio of the sample.

(6) Tensile Strength and Elongation:

Strength and Elongation of Fiber:

A sample of 100 mm long is tested at a stress rate of 100 mm/min, according to JIS-L1013. For this, used is Shimadzu Corporation's Shimadzu Autograph, AGS500D.

Strength and Elongation of Non-woven Fabric:

The strength of non-woven fabric is measured under the following condition.

Shimadzu Corporation's Shimadzu Autograph, AGS500D is used. The sample size is 5 cm×15 cm. MD strength indicates the strength of non-woven fabric in the machine direction. CD strength indicates the strength of non-woven fabric in the cross direction vertical to the machine direction. The crimp distance is 10 cm. The stress rate is 200 mm/min. The number of samples is 10.

(7) Uniformity of Non-woven Fabric:

Ten panelists macroscopically observe samples of non-woven fabric processed for fiber split, and check them for fiber distribution spots. Based on the panelists answer, the samples tested are evaluated as follows:

○: At least 7 panelists say that the samples tested have few spots.

Δ: From 4 to 6 panelists say that the samples tested have few spots.

×: At most 3 panelists say that the sample tested have few spots.

(8) Measurement of L/W:

Ten random samples of non-split fibers of one group to be tested are processed to take their cross-section pictures. The pictures are analyzed to obtain the values L and W mentioned below, and L/W is obtained from their average data.

L is the length of the longest part of the cross section of the in the direction in which the constituent components are alternately aligned to constitute the fiber (see FIG. 7).

W is the thickness of the constituent components of the fiber in the direction in which the components are contacted with each other, indicating the thickness of the cross-section profile. (see FIG. 7).

(9) Measurement of a/b:

Ten random samples of non-split fibers of one group to be tested are processed to take their cross-section pictures. The pictures are analyzed to obtain the values a and b mentioned below, and a/b is obtained from their average data.

a is the mean value of the length of the outer periphery of one component of the fiber (see FIG. 7).

b is the mean value of the contact length of one component that neighbors the adjacent component to constitute the fiber (see FIG. 7).

(10) Measurement of S1/S2:

Ten random samples of non-split fibers of one group to be tested are processed to take their cross-section pictures. The pictures are analyzed to obtain the values S1 and S2 mentioned below, and S1/S2 is obtained from their average data (see FIG. 12).

S1 is the area of the part surrounded by the bent or curved constituent components and the line that connects the both ends of the major axis of the cross section.

S2 is the cross-section area of the fiber.

(11) Spinnability (2):

While a resin sample is spun into fibers, the number of fiber cuts is counted. Based on the data, the spinnability of the resin sample is evaluated according to the following three-rank criteria.

○: Fibers not cut, and are spun very well.

Δ: Fibers cut once or two times in one hour.

×: Fibers cut 4 or more times in one hour, and spinning them is difficult.

(12) Drawing Ratio:

The drawing ratio is represented by the following equation:

$$\text{Drawing Ratio} = [\text{take-up roll speed (m/min)}]/[\text{feed roll speed (m/min)}].$$

(13) Single Fiber Fineness of Split Fibers:

From the fineness of the non-split fiber and the number of splittable segments constituting the fiber, obtained is the single fiber fineness of the split fine fibers according to the following equation:

$$\text{Fineness of Split Fiber (dtex/f)} = [\text{fineness of non-split. fiber (dtex/f)}]/[\text{number of splittable segments of the non-split fiber}]$$

(14) Treatment with High-pressure Liquid Jets:

A web having been prepared by the use of a roller carding machine, an air-laying machine, a wet-laying machine or the like is put on a conveyor belt of 80-mesh plain weave fabric, and passed just below a nozzle plate (nozzle diameter: 0.1 mm, nozzle pitch: 1 mm) at a conveyor belt speed of 20 m/min, with high-pressure water jets being applied through the nozzles onto the running web. The web is first pre-treated with 2 MPa water jets in two stages, and then treated with 5 MPa high-pressure liquid jets in four stages. Next, the web is turned backside out, and is further treated with 5 MPa high-pressure liquid jets in four stages. Through the treatment, the fibers constituting the web are split into fine fibers, and a non-woven fabric is thus obtained. The stages referred to herein indicate how many times the web passes just below the nozzles.

(15) Pressure (split) Roll:

Herein used is an induction-heating hydraulic two-roll clearance device (from Yuri Roll Co.). The processing temperature is atmospheric temperature. The processing linear pressure is 40 kg/cm. The processing rate is 10 m/min.

(16) Water Pressure Resistance:

Measured according to JIS L1092.

(17) Degree of Hollowness (%) of Fiber before pressed with roll:

Before a non-split fiber sample is deformed and flattened by external stress, its degree of hollowness is obtained from its cross-section picture according to the following equation:

Degree of Hollowness (%)=(cross-section area of hollow)/(overall cross-section area of fiber including hollow)×100.

(18) Degree of Deformation:

Non-split fibers of a group are deformed and flatted by external stress applied thereto, but these are not as yet treated with high-pressure liquid jets. Ten random samples of the group are processed to take their cross-section pictures. The pictures are analyzed to obtain the values L and W mentioned below, and the degree of deformation, L/W is obtained from their average data.

Degree of Deformation=(minor axis W)/(major axis L), the major axis L indicates the length of the longest part of the outer periphery of the fiber in the cross section, the minor axis W is perpendicular to the major axis, indicating the length of the shortest part of the outer periphery of the fiber in the cross section.

(19) Percentage of Peeling (%):

The pictures used for obtaining the degree of deformation are used. From the length of the peeled part in the contact interfaces of the constituent component of the fiber, and the length of the non-peeled part therein, the percentage of peeling is obtained according to the following equation:

Percentage of Peeling (%)=(length of peeled part in overall contact interface/length of non-peeled part in overall contact interface)×100.

Example 1

A polypropylene resin (propylene homopolymer, hereinafter referred to as PP) having MFR of 35 g/10 min and a melting point of 163° C., and a low-density polyethylene resin (hereinafter referred to as LDPE) having MFR of 16 g/10 min and a melting point of 107° C. were used for two thermoplastic resin components (A) and (B), respectively. These were spun in a mode of multi-component fiber spinning at 280° C. into non-drawn 10.2 dtex fibers. In the take-up step, alkylphosphate-K was applied to the fibers. The resulting non-drawn fibers were drawn to a drawing ratio of 4.8 times, and then cut. Thus were obtained splittable multi-component fibers having a fineness, based on corrected weight, of 2.9 dtex and a length of 10 mm. For their cross-section profile, the fibers contained at random a conjugated part, a partially conjugated part and a non-conjugated part as in FIG. 1 to FIG. 3. Table 1 shows the data of the fibers, indicating the blend ratio (% by weight) of the thermoplastic resin component (A) to the thermoplastic resin component (B), the cross-section distribution, the strength at break, the elongation at break, the spinnability and the drawing ratio of the fibers, and also the presence or absence of broken segments of the component (B) in the fibers. The fineness is in terms of the prescribed fiber length of 10000 m, according to the fiber fineness method A for the chemical fiber staple test method in JIS L1015.

Example 2

In the same manner as in Example 1, prepared were splittable multi-component fibers which, however, had a fineness of 1.0 dtex. For their cross-section profile, the fibers contained at random a conjugated part, a partially conjugated part and a non-conjugated part as in FIG. 1 to FIG. 3. The fibers were tested, and their data are given in Table 1 indicating the blend ratio (% by weight) of the thermoplastic resin component (A) to the thermoplastic resin component (B) the cross-section distribution, the strength at break, the elongation at break, the spinnability and the drawing ratio of the fibers, and also the presence or absence of broken segments of the component (B) in the fibers.

Example 3

Figure 6:
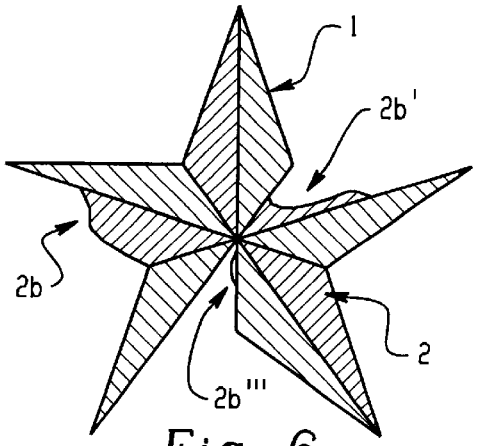
FIG. 6 is a schematic cross-sectional view showing the conjugated part, the partially conjugated part and the non-conjugated part all existing at random in a star-shaped, splittable multi-component fiber of the first aspect of the invention.

In the same. manner as in Example 1, prepared were star-shaped, splittable multi-component fibers having a cross-section profile as in FIG. 6. In this, however, the non-drawn fibers had a fineness of 7.0 dtex, and the drawn and cut fibers had a length 5 mm and a fineness, based on corrected weight, of 2.2 dtex. For their cross-section profile, the fibers had a star-shaped configuration and contained at random a conjugated part, a partially conjugated part and a non-conjugated part as in FIG. 6. The fibers were tested, and their data are given in Table 1 indicating the blend ratio (% by weight) of the thermoplastic resin component (A) to the thermoplastic resin component (B), the cross-section distribution, the strength at break, the elongation at break, the spinnability and the drawing ratio of the fibers, and also the presence or absence of broken segments of the component (B) in the fibers.

Example 4

Figure 4:
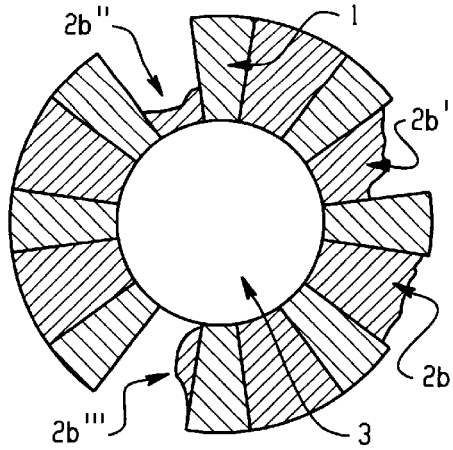
FIG. 4 is a schematic cross-sectional view showing the conjugated part, the partially conjugated part and the non-conjugated part all existing at random in a hollow, radially-aligned, splittable multi-component fiber of the first aspect of the invention.
Figure 5:
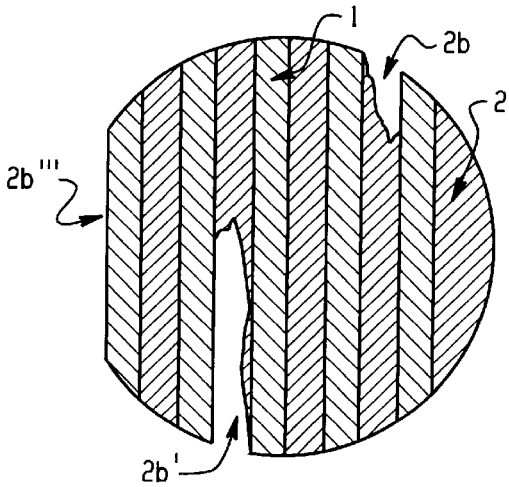
FIG. 5 is a schematic cross-sectional view showing the conjugated part, the partially conjugated part and the non-conjugated part all existing at random in a multi-layered, splittable multi-component fiber of the first aspect of the invention.

In the same manner as in Example 1, prepared were hollow, radially-aligned splittable multi-component fibers having a cross-section profile as in FIG. 4. In this, however, the non-drawn fibers had a fineness of 9.6 dtex, and the drawn and cut fibers had a length 5 mm and a fineness, based on corrected weight, of 1.7 dtex. For their cross-section profile, the fibers had a hollow, radially-aligned configuration and contained at random a conjugated part, a partially conjugated part and a non-conjugated part as in FIG. 4. The fibers were tested, and their data are given in Table 1 indicating the blend ratio (% by weight) of the thermoplastic resin component (A) to the thermoplastic resin component (B), the cross-section distribution, the strength at break, the elongation at break, the spinnability and the drawing ratio of the fibers, and also the presence or absence of broken segments of the component (B) in the fibers.

Example 5

A propylene-ethylene copolymer resin (hereinafter referred to as co-PP) having MFR of 16 g/10 min, and LDPE having MFR of 16 g/10 min were used for two thermoplastic resin components (A) and (B), respectively. These were spun in a mode of multi-component fiber spinning into non-drawn 15.0 dtex fibers. The non-drawn fibers were drawn to a drawing ratio of 3 times, then crimped and cut. Thus were obtained splittable multi-component fibers having a length of 51 mm and a fineness of 6.0 dtex. For their cross-section profile, the AL fibers contained at random a conjugated part, a partially conjugated part and a non-conjugated part as in FIG. 1 to FIG. 3. The fibers were tested, and their data are given in Table 1 indicating the blend ratio (% by weight) of the thermoplastic resin component (A) to the thermoplastic resin component (B), the cross-section distribution, the strength at break, the elongation at break, the spinnability and the drawing ratio of the fibers, and also the presence or absence of broken segments of the component (B) in the fibers.

Example 6

PP having MFR of 16 g/10 min and LDPE having MFR of 16 g/10 min were used for two thermoplastic resin components (A) and (B), respectively. These were spun in a mode of multi-component fiber spinning into non-drawn 10.5 dtex fibers. The non-drawn fibers were drawn to a drawing ratio of 3 times, then crimped and cut. Thus were obtained splittable multi-component fibers having a length of 51 mm and a fineness of 4.4 dtex. For their cross-section profile, the fibers contained at random a conjugated part, a partially conjugated part and a non-conjugated part as in FIG. 1 to FIG. 3. The fibers were tested, and their data are given in Table 1 indicating the blend ratio (% by weight) of the thermoplastic resin component (A) to the thermoplastic resin component (B) the cross-section distribution, the strength at break, the elongation at break, the spinnability and the drawing ratio of the fibers, and also the presence or absence of broken segments of the component (B) in the fibers.

Example 7

PP having MFR of 16 g/10 min and a high-density polyethylene resin (hereinafter referred to as HDPE) having MFR of 26 g/10 min were used for two thermoplastic resin components (A) and (B), respectively. To the resin component (B), added was 0.5% by weight of Dieblow HC (from DAINICHISEIKA COLOR & CHEMICALS MFG.CO., LTD. Kogyo) comprising, as the essential ingredients, an organic acid and an inorganic salt, and serving as a foaming agent. These were spun in melt at 280° C. into non-drawn 14.6 dtex fibers. In the take-up step, alkylphosphate-K was applied to the fibers. The resulting non-drawn fibers were drawn to a drawing ratio of 5.0 times, and then cut. Thus were prepared splittable multi-component fibers having a fineness of 3.3 dtex and a length of 5 mm. For their cross-section profile, the fibers contained at random a conjugated part, a partially conjugated part and a non-conjugated part as in FIG. 1 to FIG. 3. The fibers were tested, and their data are given in Table 1 indicating the blend ratio (% by weight) of the thermoplastic resin component (A) to the thermoplastic resin component (B), the cross-section distribution, the strength at break, the elongation at break, the spinnability and the drawing ratio of the fibers, and also the presence or absence of broken segments of the component (B) in the fibers.

Example 8

Splittable multi-component fibers were prepared under the same condition as in Example 7. In this, however, a polyethylene terephthalate resin (hereinafter referred to as PET) having a melt viscosity, $\eta$ of 0.635, and a co-polyethylene terephthalate resin (hereinafter referred to as co-PET) having a melt viscosity, $\eta$ of 0.575 were used for the two components (A) and (B), respectively, and spun into non-drawn 19.0 dtex fibers; the non-drawn fibers were crimped and cut; and the thus-cut fibers had a length of 51 mm and a fineness of 4.6 dtex. For their cross-section profile, the fibers contained at random a conjugated part, a partially conjugated part and a non-conjugated part as in FIG. 1 to FIG. 3. The fibers were tested, and their data are given in Table 1 indicating the blend ratio (% by weight) of the thermoplastic resin component (A) to the thermoplastic resin component (B), the cross-section distribution, the strength at break, the elongation at break, the spinnability and the drawing ratio of the fibers, and also the presence or absence of broken segments of the component (B) in the fibers.

Comparative Example 1

PP having MF R of 35 g/10 min, and HDPE having MFR of 16 g/10 min were used for two components (A) and (B) respectively. These were spun in a mode of multi-component fiber spinning at 280° C. into non-drawn 9.7 dtex fibers. The resulting non-drawn fibers were drawn to a drawing ratio of 6.4 times, and then cut. Thus were obtained splittable multi-component fibers having a fineness of 2.1 dtex and a length of 10 mm. In this condition, the segments of the component (B) did not broken in the fibers, and the cross-section profile of the fibers showed complete conjugation only (FIG. 1). The fibers were tested, and their data are given in Table 1 indicating the blend ratio (% by weight) of the thermoplastic resin component (A) to the thermoplastic resin component (B), the cross-section distribution, the strength at break, the elongation at break, the spinnability and the drawing ratio of the fibers, and also the presence or absence of broken segments of the component (B) in the fibers.

Comparative Example 2

In the same manner as in Example 1, prepared were splittable multi-component fibers for which, however, the drawing was 2 times. In this condition, the segments of the component (B) did not broken in the fibers, and the cross-section profile of the fibers showed complete conjugation only (FIG. 1). The fibers were tested, and their data are given in Table 1 indicating the blend ratio (% by weight) of the thermoplastic resin component (A) to the thermoplastic resin component (B), the cross-section distribution, the strength at break, the elongation at break, the spinnability and the drawing of the fibers, and also the presence or absence of broken segments of the component (B) in the fibers.

Comparative Example 3

In the same manner as in Example 7, prepared were splittable multi-component fibers. In this, however, azodicarbonamide was used as the foaming agent, and the amount of the foaming agent added to the component (B) was 2.0% by weight. In this condition, the spinnability of the resin components was extremely bad, and non-drawn fibers could not be obtained.

Web Production (1):

Not crimped, the fibers of Examples 1, 2, 3, 4, 7 and Comparative Examples 1, 2 were cut into short fibers having the predetermined length. These had a water content of 20% by weight. The short fibers were formed into webs according to a wet-laying process, for which was used a square wet-laying machine (25 cm×25 cm).

Web Production (2):

After mechanically crimped, the fibers of Examples 5, 6 and 8 were cut into short fibers having the predetermined length. The short fibers were formed into webs, using a roller carding machine.

High-pressure Liquid Jet Treatment:

Each web prepared in the manner of web production (1) or (2) was put on a conveyor belt of 80-mesh plain weave fabric in a belt conveyor unit. The running web was exposed to high-pressure water jets from a nozzle plate having a number of nozzles (nozzle diameter: 0.1 mm, nozzle pitch: 1 mm). Briefly, the web was first pre-treated with 2 MPa water jets in the second stage, and then treated with 5 MPa water jets in four stages. Next, the web was turned backside out, and was further treated with 5 MPa water jets in four stages. Trough the treatment, the splittable multi-component fibers constituting the web were split into fine fibers, with the split fine fibers being entangled. The fibrous article, non-woven fabric thus obtained was composed of ultra-fine fibers. This was tried in battery separators and wipers. In the test, the non-woven fabrics formed from the multi-component fibers of Examples were all good.

TABLE 1

| | Ex. 1 | Ex. 2 | Ex. 3 | Ex. 4 | Ex. 5 | Ex. 6 | Ex. 7 | Ex. 8 | Co. Ex. 1 | Co. Ex. 2 | Co. Ex. 3 |
|---|---|---|---|---|---|---|---|---|---|---|---|
| Thermoplastic Resin (A) | PP | PP | PP | PP | co-PP | PP | PP | PET | PP | PP | PP |
| MFR (g/10 min) | 35 | 35 | 35 | 35 | 16 | 16 | 16 | η = 0.635 | 35 | 35 | 16 |
| Thermoplastic Resin (B) | LDPE | LDPE | LDPE | LDPE | LDPE | LDPE | HDPE | co-PET | HDPE | LDPE | HDPE |
| MFR (g/10 min) | 16 | 16 | 16 | 16 | 16 | 16 | 26 | η = 0.575 | 26 | 16 | 26 |
| Blend Ratio (A/B) | 50/50 | 50/50 | 50/50 | 50/50 | 50/50 | 50/50 | 50/50 | 50/50 | 50/50 | 50/50 | 50/50 |
| Cross-section Distribution | FIGS. 1–3 | FIGS. 1–3 | FIG. 6 | FIG. 4 | FIGS. 1–3 | FIGS. 1–3 | FIGS. 1–3 | FIGS. 1–3 | FIG. 1 only | FIG. 1 only | — |
| Additives | — | — | — | — | — | — | yes | yes | — | — | yes |
| Amount of Additive (%) | — | — | — | — | — | — | 0.5 | 0.5 | — | — | 2 |
| Spinnability | ○ | ○ | ○ | ○ | ○ | ○ | ○ | ○ | ○ | ○ | x |
| Drawing | 4.8 | 4.5 | 4.3 | 4.5 | 3 | 3 | 5 | 3 | 6.4 | 2 | — |
| Broken Segment of (B) | Yes | yes | yes | yes | yes | yes | yes | yes | no | no | — |
| Fineness of Non-drawn Fiber (dtex/f) | 10.2 | 3.6 | 7 | 9.6 | 15 | 10.5 | 14.6 | 19 | 9.7 | 10.1 | — |
| Fineness of Drawn Fiber (dtex/f) | 2.9 | 1 | 2.2 | 1.7 | 6 | 4.4 | 3.3 | 4.6 | 2.1 | 4.8 | — |
| Strength at break (cN/dtex) | 2 | 2.3 | 2.2 | 2.2 | 2.5 | 2.4 | 2.3 | 2.9 | 3.6 | 1.1 | — |
| Elongation (%) | 34 | 32 | 34 | 34 | 64 | 58 | 112 | 65 | 46 | 150 | — |
| Length of Cut Fiber (mm) | 10 | 10 | 5 | 5 | 51 | 51 | 5 | 51 | 10 | 10 | — |
| Web Production | wet-laying | wet-laying | wet-laying | wet-laying | carding | carding | wet-laying | carding | wet-laying | wet-laying | — |
| Metsuke (weight, g/m$^2$) | 56 | 74 | 51 | 33 | 30 | 53 | 46 | 42 | 51 | 65 | — |
| Split ratio (%) | 88 | 85 | 92 | 90 | 75 | 73 | 83 | 80 | 40 | 31 | — |
| Uniformity | ○ | ○ | ○ | ○ | ○ | Δ | ○ | ○ | x | x | — |
| Strength at break of Non-woven Fabric (N/5 cm) MD | 52 | 68 | 45 | 36 | 77 | 105 | 35 | 133 | 68 | 44 | — |
| CD | 47 | 60 | 38 | 35 | 11 | 14 | 30 | 12 | 61 | 41 | — |

PP: polyethylene,
LDPE: low-density polyethylene,
HDPE: high-density polyethylene
PET: polyethylene terephthalate,
co-PET: co-polyethylene terephthalate As is obvious from the data in Table 1, the split ratio of multi-component fibers increases when low-density polyethylene is used therein or a foaming agent is added to the component (B) constituting them so that each one of them contains both a partially conjugated part and a non-conjugated part. In the prior art technique, a multi-component fiber that comprises a combination of relatively highly miscible resins is difficult to split into fine constituent fibers. The present invention ensures improved split of even such hardly-splittable multi-component fibers, and has provided well splittable multi-component fibers capable of being formed into soft and tight non-woven fabrics.

Examples 9 to 11

A high-melting-point resin, polypropylene (propylene homopolymer), and a low-melting-point resin, high-density polyethylene were used for the components (A) and (B) respectively. The two resins, components (A) and (B) were spun in a ratio by volume of 50/50 through a multi-component spinneret into splittable multi-component fibers having a single fiber fineness of 7.5 dtex and having a cross-section profile as in FIG. 7. In the take-up step, potassium alkylphosphate was applied to the fibers. The non-drawn fibers were drawn to a drawing of 4.1 times at 90° C., to which was applied a wet-laying aid. Then, these were cut into short fibers having a length of 10 mm. These had water content of 20% by weight.

To the short fibers, added were 20% by weight of core/sheath bi-component fibers of polypropylene (core)/low-densitylpolyethylene (sheath) (EAC fibers from Chisso Corporation). The fiber blend was formed into webs according to a wet-laying process, for which was used a square wet-laying machine (25 cm×25 cm). Using a Yankee drier (from Kumagai Riki Kogyo), each web was dried at 105° C. for 3 minutes for pre-bonding it. The webs were exposed to high-pressure liquid jets in the manner mentioned above, and then dried in a drier at 80° C. to be fibrous articles.

Example 12

A high-melting-point resin, polypropylene (propylene homopolymer), and a low-melting-point resin, high-density polyethylene were used for the components (A) and (B) respectively. The two resins, components (A) and (B) were spun in a ratio by volume of 50/50 through a multi-component spinneret into splittable multi-component fibers having a single fiber fineness of 7.5 dtex and having a cross-section profile as in FIG. 8. In the take-up step, potassium alkylphosphate was applied to the fibers. The non-drawn fibers were drawn to a drawing of 1.5 times at 90° C., then crimped and cut into short fibers having a length of 51 mm.

Using a roller carding machine, the short fibers were formed into webs. The webs were exposed to high-pressure liquid jets in the manner mentioned above, and then dried in a drier at 80° C. to be fibrous articles. The fibrous articles were used for the top sheet of diapers for adults. The top sheet had a good and soft feel, and its strength was high. The fibrous articles produced herein are extremely favorable for absorbent articles.

Example 13

In the same manner as in Example 9, splittable multi-component fibers were prepared, for which, however, used was a multi-component spinneret to give fibers having a cross-section profile of FIG. 9. The fibers were formed into fibrous articles like in Example 9.

Example 14

In the same manner as in Example 9, splittable multi-component fibers were prepared, for which, however, used was linear low-density polyethylene and not high-density polyethylene. The fibers were formed into fibrous articles like in Example 9.

Example 15

In the same manner as in Example 9, splittable multi-component fibers were prepared, for which, however, used was low-density polyethylene and not high-density polyethylene. The fibers were formed into fibrous articles like in Example 9.

Example 16

A high-melting-point resin, polypropylene (propylene homopolymer), and a low-melting-point resin, high-density polyethylene were used for the components (A) and (B) respectively. The two resins, components (A) and (B) were spun in a ratio by volume of 50/50 through a multi-component spinneret into splittable multi-component fibers having a single fiber fineness of 20.0 dtex and having a cross-section profile as in FIG. 7. In the take-up step, potassium alkylphosphate was applied to the fibers. The non-drawn fibers were drawn to a drawing of 4.1 times at 90° C., to which was applied a wet-laying aid. Then, these were cut into short fibers having a length of 10 mm. These had a water content of 20% by weight. To the short fibers, added were 20% by weight of core/sheath bi-component fibers of polypropylene (core)/low-density polyethylene (sheath) (EAC fibers from Chisso Corporation). The fiber blend was formed into webs according to a wet-laying process, for which was used a square wet-laying machine (25 cm×25 cm). Using a Yankee drier (from Kumagai Riki Kogyo), each web was dried at 105° C. for 3 minutes for pre-bonding it. The webs were exposed to high-pressure liquid jets in the manner mentioned above, and then dried in a drier at 80° C. to be fibrous articles.

Example 17

In the same manner as in Example 16, splittable multi-component fibers were prepared, for which, however, used was a multi-component spinneret to give fibers having a cross-section profile of FIG. 8. The fibers were formed into fibrous articles like in Example 16.

The spinning and drawing condition for the fibers of Examples 9 to 17, the physical properties of the fibers, the profile of the fibers, the physical properties of the non-woven fabrics comprising the fibers, and the split ratio in the non-woven fabrics are given in Table 2 below.

TABLE 2

| | Ex. 9 | Ex. 10 | Ex. 11 | Ex. 12 | Ex. 13 | Ex. 14 | Ex. 15 | Ex. 16 | Ex. 17 |
|---|---|---|---|---|---|---|---|---|---|
| Spinning and Drawing Condition | | | | | | | | | |
| High-melting-point Resin A | PP | PP | PP | PP | PP | PP | PP | PP | PP |
| MFR | 16 | 26 | 16 | 35 | 10 | 35 | 35 | 35 | 5 |
| Low-melting-point Resin B | HDPE | HDPE | HDPE | HDPE | HDPE | L-LDPE | LDPE | HDPE | HDPE |
| MI | 16 | 26 | 16 | 26 | 15 | 23 | 20 | 9 | 26 |
| MFR (g/10 min) of Spun Fibers A/B | 30/25 | 30/25 | 30/25 | 41/40 | 25/30 | 40/29 | 40/32 | 53/11 | 6/29 |
| Ratio of A/B | 1.2 | 1.2 | 1.2 | 1.1 | 0.8 | 1.4 | 1.3 | 4.8 | 0.2 |
| Spinnability | ○ | ○ | ○ | ○ | ○ | ○ | ○ | Δ | Δ |
| Physical Properties of Fibers | | | | | | | | | |
| Fineness of Drawn Fibers (dtex/f) | 2.0 | 2.0 | 2.0 | 5.0 | 1.0 | 2.2 | 5.0 | 5.1 | 5.0 |
| Strength at break (cN/dtex) | 3.2 | 3.0 | 2.9 | 1.7 | 2.8 | 2.8 | 2.6 | 2.8 | 2.6 |
| Elongation (%) | 53 | 48 | 45 | 150 | 41 | 52 | 65 | 60 | 65 |
| Profile of Fibers | | | | | | | | | |
| L/W | 10 | 4 | 18 | 5 | 10 | 8 | 8 | 8 | 8 |
| a/b | 0.5 | 0.25 | 1.3 | 0.08 | 2.6 | 0.5 | 0.5 | 0.5 | 0.5 |
| S1/S2 | 0.6 | 0.2 | 0.7 | 0.2 | 0.2 | 0.6 | 0.6 | 0.5 | 0.5 |
| Cross-section Profile | FIG. 7 | FIG. 7 | FIG. 7 | FIG.8 | FIG. 9 | FIG. 7 | FIG. 7 | FIG. 7 | FIG. 8 |
| Physical Properties of Non-woven Fabrics, Split ratio | | | | | | | | | |
| Split ratio (%) | 85 | 82 | 89 | 60 | 82 | 80 | 85 | 73 | 79 |
| Uniformity | ○ | ○ | ○ | Δ | Δ | ○ | ○ | Δ | Δ |
| Single Fiber Fineness of Split Fine Fibers (dtex/f) | 0.13 | 0.13 | 0.13 | 0.31 | 0.25 | 0.14 | 0.31 | 0.32 | 0.16 |
| Strength at break (N/5 cm) | 80 | 95 | 90 | 75 | 85 | 75 | 75 | 80 | 85 |

Example 18

A high-melting-point resin, PET (K101 from Kanebo LTD.) having a relative viscosity (measured in a 1/1 mixed solvent of phenol/tetrachloroethane at 20° C.) of 0.60, and a low-melting-point resin, polypropylene (propylene homopolymer having MFR of 16 g/10 min) were used for the components (A) and (B), respectively. The two resins, components (A) and (B) were spun in a ratio by volume of 50/50 through a multi-component spinneret into splittable multi-component fibers having a single fiber fineness of 15.0 dtex and having a cross-section profile as in FIG. 7. In the take-up step, potassium alkylphosphate was applied to the fibers. The non-drawn fibers were drawn to a drawing of 3.3 times at 90° C., to which was applied a wet-laying aid. Then, these were cut into short fibers having a length of 10 mm. These had a water content of 20% by, weight. To the short fibers, added were 20% by weight of core/sheath bi-component fibers of polypropylene (core)/low-density polyethylene (sheath) (EAC fibers from Chisso:Corporation). The fiber blend was formed into webs according to a wet-laying process, for which was used a square wet-laying machine (25 cm×25 cm). Using a Yankee drier (from Kumagai Riki Kogyo), each web was dried at 105° C. for 3 minutes for pre-bonding it. The webs were exposed to high-pressure liquid jets in the manner mentioned above, and then dried in a drier at 80° C. to be fibrous articles.

Example 19

In the same manner as in Example 9, splittable multi-component fibers were prepared, for which, however, used was a multi-component spinneret to give fibers having a cross-section profile of FIG. 10. The fibers were formed into fibrous articles like in Example 9.

Example 20

A high-melting-point resin, polypropylene (propylene homopolymer), and a low-melting-point resin, high-density polyethylene were used for the components (A) and (B) respectively. The two resins, components (A) and (B) were spun in a ratio by volume of 50/50 through a multi-component spinneret into splittable multi-component fibers having a single fiber fineness of 7.5 dtex and having a cross-section profile as in FIG. 7 In the take-up step, potassium alkylphosphate was applied to the fibers. The non-drawn fibers were drawn to a drawing of 4.1 times at 90° C., to which was applied a wet-laying aid. Then, these were cut into short fibers having a length of 10 mm. These had water content of 20% by weight. To the short fibers, added were 20% by weight of core/sheath bi-component fibers of polypropylene (core)/low-density polyethylene (sheath) (EAC fibers from Chisso). The fiber blend was formed into webs according to a wet-laying process, for which was used a square wet-laying machine (25 cm×25: cm). Using a Yankee drier (from Kumagai Riki Kogyo) each web was dried at 105° C. for 3 minutes for pre-bonding it. The webs were exposed to high-pressure liquid jets in the manner mentioned above, and then dried in a drier at 80° C. to be fibrous articles.

Example 21

A high-melting-point resin, polypropylene (propylene homopolymer), and a low-melting-point resin, high-density polyethylene were used for the components (A) and (B) respectively. The two resins, components (A) and (B) were spun in a ratio by volume of 50/50 through a multi-component spinneret into splittable multi-component fibers having a cross-section profile as in FIG. 7, according to a spun-bonding method. The fibers having been jetted out of the spinneret were led into an air sucker and drawn therein under suction to be long multi-component fibers having a single fiber fineness of 2.0 dtex. Next, the long fibers thus having been led out of the air sucker were statically charged in a static charging device, and then dashed against a reflector plate to be opened. The thus-opened long fibers were collected to be a long fiber web on an endless mesh conveyor belt provided with a suction device on its back side. The long fibers constituting the web were split by pressing the web against a pressure roll, and the thus-processed web was then embossed with an embossing roll having an area ratio of 15% and heated at 120° C. Thus was obtained an embossed fibrous article.

The spinning and drawing condition for the fibers of Examples 18 to 21, the physical properties of the fibers, the profile of the fibers, the physical properties of the non-woven fabrics comprising the fibers, and the split ratio in the non-woven fabrics are given in Table 3 below.

Comparative Examples 4, 5

A high-melting-point resin, polypropylene (propylene homopolymer), and a low-melting-point resin, high-density polyethylene were used for the components (A) and (B), respectively. The two resins, components (A) and (B) were spun in a ratio by volume of 50/50 through a multi-component spinneret into spltittable multi-component fibers having a single fiber fineness of 7.5 dtex and having a cross-section profile as in FIG. 7. In the take-up step, potassium alkylphosphate was applied to the fibers. The non-drawn fibers were drawn to a drawing of 4.1 times at 90° C., to which was applied a wet-laying aid. Then, these were cut into short fibers having a length of 10 mm. These had a water content of 20% by weight. To the short fibers, added were 20% by weight of core/sheath bi-component fibers of polypropylene (core)/low-density polyethylene (sheath) (EAC fibers from Chisso Corporation). The fiber blend was formed into webs according to a wet-laying process, for which was used a square wet-laying machine (25 cm×25 cm). Using a Yankee drier (from Kumagal Riki Kogyo), each web was dried at 105° C. for 3 minutes for pre-bonding it. The webs were exposed to high-pressure liquid jets in the manner mentioned above, and then dried in a drier at 80° C. to be fibrous articles. The spinning and drawing condition for the fibers, the physical properties of the fibers, the profile of the fibers, the physical properties of the non-woven fabrics comprising the fibers, and the split ratio in the non-woven fabrics are given in Table 3 below.

Comparative Example 6

In the same manner as in Example 9, splittable multi-component fibers were prepared, for which, however, used was a multi-component spinneret to give fibers having a cross-section profile of FIG. 15. The fibers were formed into fibrous articles like in Example 9. The spinning and drawing condition for the fibers, the physical properties of the fibers, the profile of the fibers, the physical properties of the non-woven fabrics comprising the fibers, and the split ratio in the non-woven fabrics are given in Table 3 below.

Comparative Example 7

In the same manner as in Example 9, splittable multi-component fibers were prepared, for which, however, used was a multi-component spinneret, to give fibers having a cross-section profile of FIG. 16. The fibers were formed into fibrous articles like in Example 9. The spinning and drawing condition for the fibers, the physical properties of the fibers, the profile of the fibers, the physical properties of the non-woven fabrics comprising the fibers, and the split ratio in the non-woven fabrics are given in Table 3 below.

Comparative Example 8

In the same manner as in Example 21, splittable multi-component fibers were prepared, for which, however, used was a multi-component spinneret to give fibers having a cross-section profile of FIG. 16. The fibers were formed into fibrous articles like in Example 21. The spinning and drawing condition for the fibers, the physical properties of the fibers, the profile of the fibers, the physical properties of the non-woven fabrics comprising the fibers, and the split ratio in the non-woven fabrics are given in Table 3 below.

TABLE 3

| | Ex. 18 | Ex. 19 | Ex. 20 | Ex. 21 | Co. Ex. 4 | Co. Ex. 5 | Co. Ex. 6 | Co. Ex. 7 | Co. Ex. 8 |
|---|---|---|---|---|---|---|---|---|---|
| Spinning and Drawing Condition | | | | | | | | | |
| High-melting-point Resin A | PET | PP | PP | PP | PP | PP | PP | PP | PP |
| MFR | — | 35 | 10 | 40 | 16 | 16 | 16 | 16 | 40 |
| Low-melting-point Resin B | PP | HDPE | HDPE | HDPE | HDPE | HDPE | HDPE | HDPE | HDPE |
| MI | — | 26 | 10 | 20 | 16 | 16 | 16 | 16 | 20 |
| MFR (g/10 min) of Spun Fibers A/B | — | 30/25 | 30/25 | 40/33 | 23/26 | 33/33 | 30/25 | 30/25 | 40/33 |
| Ratio of A/B | — | 1.2 | 1.2 | 1.2 | 0.9 | 1.0 | 1.2 | 1.2 | 1.2 |
| Spinnability | Δ | Δ | Δ | ○ | ○ | x | ○ | ○ | ○ |
| Physical Properties of Fibers | | | | | | | | | |
| Fineness of Drawn Fibers (dtex/f) | 5.0 | 3.0 | 3.0 | 2.0 | 2.0 | 2.0 | 2.0 | 2.0 | 2.0 |
| Strength at break (cN/dtex) | 3.8 | 3.0 | 2.8 | 1.5 | 2.8 | 2.6 | 3.0 | 2.8 | 1.7 |
| Elongation (%) | 35 | 36 | 39 | 300 | 41 | 48 | 39 | 46 | 360 |
| Profile of Fibers | | | | | | | | | |
| L/W | 8 | 8 | 8 | 8 | 2.5 | 30 | 8 | — | — |
| a/b | 0.5 | 0.25 | 0.25 | 0.25 | 4.5 | 2 | 0.5 | 0.2 | 0.2 |
| S1/S2 | 0.3 | 0.1 | 1.2 | 0.4 | 0.1 | 1.0 | 0 | — | — |
| Cross-section Profile | FIG. 7 | FIG. 10 | FIG. 7 | FIG. 7 | FIG.7 | FIG. 7 | FIG. 15 | FIG. 16 | FIG. 16 |
| Physical Properties of Non-woven Fabrics, Split ratio | | | | | | | | | |
| Split ratio (%) | 90 | 70 | 85 | 70 | 45 | — | 62 | 40 | 5 |
| Uniformity | ○ | Δ | ○ | ○ | x | — | Δ | x | ○ |
| Single Fiber Fineness of Split Fine Fibers (dtex/f) | 0.31 | 0.13 | 0.13 | 0.13 | 0.13 | — | 0.13 | 0.13 | 0.13 |
| Strength at break (N/5 cm) | 75 | 70 | 85 | 55 | 50 | — | 60 | 45 | 40 |

Examples 22, 23

In the same manner as in the former step (not including the step of exposing webs to high-pressure liquid jets to give fibrous articles) of Example 9, prepared was a web (A) having a Metsuke (weight) of 10 g/m$^2$. On the other hand, prepared were short, core/sheath bi-component fibers of polypropylene (core)/high-density polyethylene (sheath) (ESC fibers from Chisso Corporation) having a fineness of 2.2 dtex and a length of 51 mm. The short fibers were formed into a card web (B) having a Metsuke (weight) of 10 g/m$^2$. A and B were laminated to form an A/B laminate (Example 22), and an A/B/A laminate (Example 23). These laminates were exposed to high-pressure liquid jets in the manner as above, and then dried in a drier at 80° C. to be laminated fibrous articles. These laminated fibrous articles were tried as wipers, and were all very good.

Example 24

A high-melting-point resin, polypropylene (propylene homopolymer), and a low-melting-point resin, high-density polyethylene were used for the components (A) and (B), respectively. The two resins, components (A) and (B) were spun in a ratio by volume of 50/50 through a multi-component spinneret into splittable multi-component fibers having a single fiber fineness of 2.0 dtex and having a cross-section profile as in FIG. 7, according to a spun-bonding method. The spun-bonded web thus prepared had a Metsuke (weight) of 10 g/m$^2$, and this is for an interlayer of laminated fibrous articles. On the other hand, the same components (A) and (B) were spun in a ratio by volume of 50/50 through a multi-component spinneret into core/sheath multi-component fibers of A (core)/B (sheath) having a single fiber fineness of 2.0 dtex, also according to a spun-bond method. The spun-bonded web thus prepared had a Metsuke (unit weight) of 5.0 g/m$^2$, and this is for upper and lower layers of laminated fibrous articles. These webs were laminated, with the interlayer web being ant sandwiched between the upper and lower webs. The resulting fibrous laminate was pressed against a pressure roll whereby the fibers constituting it were split. The thus-processed laminate was then embossed with an embossing roll having an area ratio of 15% and heated at 120° C. Thus was obtained an embossed laminated fibrous article. This was used for the top sheet of diapers for adults. The top sheet had good water pressure resistance and high mechanical strength. The laminated fibrous article produced herein is extremely favorable for absorbent articles.

As is obvious from the data in Table 2 and Table 3, the fibrous articles and the laminated fibrous articles obtained in the Examples of the second aspect of the invention all ensured higher fiber split than those of the Comparative Examples when processed under the same condition. This means that the fibrous articles of the invention do not require treating with severe high-pressure liquid jets for splitting the constituent fibers into fine fibers. Therefore, according to the technique of the invention, even non-woven fabrics having a relatively. low Metsuke (weight) can be well produced and the uniformity of such non-woven fabrics produced in the invention is disordered little, and in addition, the cost for the treatment with high-pressure liquid jets can be significantly reduced.

Examples 25 to 27

A high-melting-point resin, polypropylene (propylene homopolymer having a melting point of 163° C.), and a low-melting-point resin, high-density polyethylene (having a melting point of 131° C.) were used for the components (A) and (B) respectively. The two resins, components (A) and (B) were spun in a ratio by volume of 50/50 through a multi-component spinneret into splittable multi-component fibers having a single fiber fineness of 7.5 dtex and having a cross-section profile as in FIG. 17. In the take-up step, potassium alkylphosphate was applied to the fibers. The non-drawn fibers were drawn to a drawing of 4.3 times at 90° C., then mechanically crimped and cut into short fibers having a length of 51 mm.

The short fibers were formed into webs, using a roller carding machine, and then exposed to high-pressure liquid jets in the manner as above. These were then dried in a drier at 80° C. to be fibrous articles.

The spinning. and drawing condition for the fibers, and also the data of the fibers including the physical properties of the fibers, the multi-component profile of the fibers, the physical properties of the non-woven fabrics comprising the fibers, and the split ratio in the non-woven fabrics are given in Table 4 below.

Example 28

A high-melting-point resin, polypropylene (propylene homopolymer having a melting point of 163° C.), and a low-melting-point resin, high-density polyethylene (having a melting point of 131° C.) were used for the components (A) and (B), respectively. The two resins, components (A) and (B) were spun in a ratio by volume of 70/30 through a multi-component spinneret into splittable multi-component fibers having a single fiber fineness of 7.5 dtex and having a cross-section profile as in FIG. 17. In the take-up step, potassium alkylphosphate was applied to the fibers. The non-drawn fibers were drawn to a drawing of 4.3 times at 90° C., then mechanically crimped and cut into short fibers having a length of 51mm. The short fibers were formed into webs, using a roller carding machine, and then exposed to high-pressure liquid jets in the manner as above. These were then dried in a drier at 80° C. to be fibrous articles.

The spinning and drawing condition for the fibers, and also the data of the fibers including the physical properties of the fibers, the multi-component profile of the fibers, the physical properties of the non-woven fabrics comprising the fibers, and the split ratio in the non-woven fabrics are given in Table 4 below.

Example 29

A high-melting-point resin, polypropylene (propylene homopolymer having a melting point of 163° C.), and a low-melting-point resin, high-density polyethylene (having a melting point of 133° C.) were used for the components (A) and (B), respectively. The two resins, components (A) and (B) were spun in a ratio by volume of 50/50 through a multi-component spinneret into splittable multi-component fibers having a single fiber fineness of 4.0 dtex and having a cross-section profile as in FIG. 18. In the take-up step, potassium alkylphosphate was applied to the fibers. The non-drawn fibers were drawn to a drawing of 4.1 times at 90° C. and then cut into short fibers having a length of 5 mm. These had a water content of 20% by weight. To the short fibers, added were 20% by weight of core/sheath bi-component fibers of polypropylene/low-density polyethylene (EAC fibers from Chisso). The fiber blend was formed into webs according to a wet-laying process, for which was used a square wet-laying machine (25 cm×25 cm). Using a Yankee drier (from Kumagai Riki Kogyo), each web was dried at 105° C. for 3 minutes for pre-bonding it. The webs were exposed to high-pressure liquid jets in the manner mentioned above, and then dried in a drier at 80° C. to be fibrous articles.

The spinning and drawing condition for the fibers, and also the data of the fibers including the physical properties of the fibers, the multi-component profile of the fibers, the physical properties of the non-woven fabrics comprising the fibers, and the split ratio in the non-woven fabrics are given in Table 4 below.

Example 30

A high-melting-point resin, polypropylene (propylene homopolymer having a melting point of 165° C.), and a low-melting-point resin, linear low-density polyethylene were used for the components (A) and (B), respectively. The two resins, components (A) and (B) were spun in a ratio by volume of 50/50 through a multi-component spinneret into splittable multi-component fibers having a single fiber fineness of 7.5 dtex and having a cross-section profile as in FIG. 17. In the take-up step, potassium alkylphosphate was applied to the fibers. The non-drawn fibers were drawn to a drawing of 3.8 times at 90° C. and then cut into short fibers having a length of 5 mm. These had water content of 20% by weight. To the short fibers, added were 20% by weight of core/sheath bi-component fibers of polypropylene/low-density polyethylene (EAC fibers from Chisso Corporation). The fiber blend was formed into webs according to a wet-laying process, for which was used a square wet-laying machine (25 cm×25 cm). Using a Yankee drier (from Kumagai Riki Kogyo), each web was dried at 105° C. for 3 minutes for pre-bonding it. The webs were exposed to high-pressure liquid jets in the manner mentioned above, and then dried in a drier at 80° C. to be fibrous articles.

The spinning and drawing condition for the fibers, and also the data of the fibers including the physical properties of the fibers, the multi-component profile of the fibers, the physical properties of the non-woven fabrics comprising the fibers, and the split ratio in the non-woven fabrics are given in Table 4 below.

Examples 31, 32

A high-melting-point resin, polypropylene (propylene homopolymer having a melting point of 163° C.), and a low-melting-point resin, high-density polyethylene (having a melting point of 131° C.) were used for the components (A) and (B), respectively. The two resins, components (A) and (B) were spun in a ratio by volume of 50/50 through a multi-component spinneret into splittable multi-component fibers having a single fiber fineness of 20.0 dtex and having a cross-section profile as in FIG. 17. In the take-up step, potassium alkylphosphate was applied to the fibers. The non-drawn fibers were drawn to a drawing of 4.0 times at 90° C., then mechanically crimped and cut into short fibers having a length of 51 mm. The short fibers were formed into webs, using a roller carding machine, and then exposed to high-pressure liquid jets in the manner as above. These were then dried in a drier at 80° C. to be fibrous articles.

The spinning and drawing condition for the fibers, and also the data of the fibers including the physical properties of the fibers, the multi-component profile of the fibers, the physical properties of the non-woven fabrics comprising the fibers, and the split ratio in the non-woven fabrics are given in Table 4 below.

Example 33

A high-melting-point resin, polypropylene (propylene homopolymer having a melting point of 163° C.), and a low-melting-point resin, high-density polyethylene (having a melting point of 133° C.) were used for the components (A) and (B), respectively. The two resins, components (A) and (B) were spun in a ratio by volume of 50/50 through a multi-component spinneret into splittable multi-component fibers having a single fiber fineness of 50.0 dtex and having a cross-section profile as in FIG. 18. In the take-up step, potassium alkylphosphate was applied to the fibers. The non-drawn fibers were drawn to a drawing of 5.0 times at 90° C., then mechanically crimped and cut into short fibers having a length of 51 mm. The short fibers were formed into webs, using a roller carding machine, and then exposed to high-pressure liquid jets in the manner as above. These were then dried in a drier at 80° C. to be fibrous articles.

The spinning and drawing condition for the fibers, and also the data of the fibers including the physical properties of the fibers, the multi-component profile of the fibers, the physical properties of the non-woven fabrics comprising the fibers, and the split ratio in the non-woven fabrics are given in Table 4 below.

TABLE 4

| | Ex. 25 | Ex. 26 | Ex. 27 | Ex. 28 | Ex. 29 | Ex. 30 | Ex. 31 | Ex. 32 | Ex. 33 |
|---|---|---|---|---|---|---|---|---|---|
| Spinning and Drawing Condition | | | | | | | | | |
| High-melting-point Resin A | PP | PP | PP | PP | PP | PP | PP | PP | PP |
| MFR | 16 | 20 | 16 | 16 | 20 | 20 | 8 | 35 | 15 |
| Low-melting-point Resin B | HDPE | HDPE | HDPE | HDPE | HDPE | L-LDPE | HDPE | HDPE | HDPE |
| MI | 16 | 26 | 16 | 16 | 20 | 30 | 26 | 9 | 16 |
| MFR (g/10 min) of Spun Fibers A/B | 30/25 | 40/35 | 30/25 | 17/25 | 35/30 | 40/45 | 6/29 | 53/11 | 29/24 |
| Ratio of A/B | 1.2 | 1.1 | 1.2 | 0.7 | 1.2 | 0.9 | 0.2 | 4.8 | 1.2 |
| Spinnability | ○ | ○ | ○ | ○ | ○ | ○ | Δ | Δ | ○ |
| Physical Properties of Fibers | | | | | | | | | |
| Fineness of Drawn Fibers (dtex/f) | 2.0 | 2.0 | 2.0 | 2.0 | 1.0 | 2.2 | 5.0 | 5.1 | 10 |
| Strength at break (cN/dtex) | 4.2 | 4.0 | 3.9 | 4.3 | 4.8 | 3.8 | 3.6 | 3.8 | 5.6 |
| Elongation (%) | 53 | 48 | 45 | 45 | 41 | 52 | 65 | 60 | 75 |
| Multi-component Profile of Fibers | | | | | | | | | |
| W/L | 0.6 | 0.3 | 0.7 | 2.2 | 0.6 | 0.6 | 0.8 | 0.8 | 0.7 |
| Degree of Hollowness (%) | 21 | 7 | 25 | 38 | 17 | 15 | 37 | 35 | 35 |
| Number of Segments with radius of curvature $\rho < r$ | zero | 1 | 3 | 2 | 2 | 3 | 1 | 1 | 2 |
| Physical Properties of Non-woven Fabrics, Split ratio | | | | | | | | | |
| Split ratio (%) | 75 | 72 | 84 | 89 | 81 | 80 | 79 | 73 | 79 |
| Uniformity | ○ | ○ | ○ | ○ | ○ | ○ | Δ | Δ | ○ |
| Single Fiber Fineness of Split Fine Fibers (dtex/f) | 0.13 | 0.13 | 0.13 | 0.13 | 0.03 | 0.14 | 0.31 | 0.32 | 0.31 |
| Strength at break (N/5 cm) | 170 | 180 | 180 | 155 | 85 | 56 | 155 | 110 | 85 |

Example 34

A high-melting-point resin, syndiotactic polystyrene (styrene homopolymer having a degree of racemipentad syndiotacticity of 95% and having a melting point of 270° C.) and a low-melting-point resin, polypropylene (propylene homopolymer having a melting point of 163° C.) were used for the components (A) and (B), respectively. The two resins, components (A) and (B) were spun in a ratio by volume of 50/50 through a multi-component spinneret into splittable multi-component fibers having a single fiber fineness of 4.5 dtex and having a cross-section profile as in FIG. 17. In the take-up step, potassium alkylphosphate was applied to the fibers. The non-drawn fibers were drawn to a drawing of 1.7 times at 120° C., then mechanically crimped and cut into short fibers having a length of 51 mm.

The short fibers were formed into webs, using a roller carding machine, and then exposed to high-pressure liquid jets in the manner as above. These were then dried in a drier at 80° C. to be fibrous:articles of the invention.

The spinning and drawing condition for the fibers, and also the data of the fibers including the physical properties of the fibers, the multi-component profile of the fibers, the physical properties of the non-woven fabrics comprising the fibers, and the split ratio in the non-woven fabrics are given in Table 5 below.

Comparative Example 9

A high-melting-point resin, polypropylene (propylene homopolymer having: a melting point of 163° C.), and a low-melting-point resin, high-density polyethylene (having a melting point of 133° C.) were used for the components (A) and (B), respectively. The two resins, components (A) and (B) were spun in a ratio by volume of 50/50 through a multi-component spinneret into splittable multi-component fibers having a single fiber fineness of 7.5 dtex and having a cross-section profile (with hollowness of 0%) as in FIG. 20. In the take-up step, potassium alkylphosphate was applied to the fibers. The non-drawn fibers were drawn to a drawing of 4.5 times at 90° C., then mechanically crimped and cut into short fibers having a length of 51 mm. The short fibers were formed into webs, using a roller carding machine, and then exposed to high-pressure liquid jets in the manner as above. These were then dried in a drier at 80° C. to be fibrous articles.

Comparative Example 10

A high-melting-point resin, polypropylene (propylene homopolymer having a melting point of 163° C.), and a low-melting-point resin, high-density polyethylene (having a melting point of 131° C.) were used for the components (A) and (B), respectively. Spinning the two resins, components (A) and (B) in a ratio by volume of 50/50 was tried through a multi-component spinneret into splittable multi-component fibers having a cross-section profile as in FIG. 17. In this, however, the degree of hollowness in the cross section was 45% and was too high, no fiber sample was obtained.

Comparative Example 11

A high-melting-point resin, polypropylene (propylene homopolymer having a melting point of 163° C.), and a low-melting-point resin, high-density polyethylene (having a melting point of 131° C.) were used for the components (A) and (B), respectively. The two resins, components (A) and (B) were spun in a ratio by volume of 50/50 through a multi-component spinneret into splittable multi-component fibers having a single fiber fineness of 10.0 dtex and having a cross-section profile as in FIG. 19. In the take-up step, potassium alkylphosphate was applied to the fibers. The non-drawn fibers were drawn to a drawing of 5.5 times at 90° C., then mechanically crimped and cut into short fibers having a length of 51 mm. The short fibers were formed into webs, using a roller carding machine, and then exposed to high-pressure liquid jets in the manner as above. These were then dried in a drier at 80° C. to be fibrous articles.

The spinning and drawing condition for the fibers of Comparative Examples 9 to 11, and also the data of the fibers including the physical properties of the fibers, the multi-component profile of the fibers, the physical properties of the non-woven fabrics comprising the fibers, and the split ratio in the non-woven fabrics are given in Table 5 below.

TABLE 5

| | | Ex. 34 | Co. Ex. 9 | Co. Ex. 10 | Co. Ex. 11 |
|---|---|---|---|---|---|
| Spinning and Drawing Condition | High-melting-point Resin A | SPS | PP | PP | PP |
| | MFR | 20 | 16 | 16 | 16 |
| | Low-melting-point Resin B | PP | HDPE | HDPE | HDPE |
| | MI | 16 | 16 | 16 | 16 |
| | MFR (g/10 min) of Spun Fibers A/B | 35/25 | 30/25 | 23/26 | 33/33 |
| | Ratio of A/B | 1.4 | 1.2 | 0.9 | 1.0 |
| | Spinnability | O | O | x | O |
| Physical Properties of Fibers | Fineness of Drawn Fibers (dtex/f) | 2.7 | 2.0 | — | 2.0 |
| | Strength at break (cN/dtex) | 1.8 | 3.8 | — | 3.6 |
| | Elongation (%) | 11 | 46 | — | 48 |
| Multi-component Profile of Fibers | W/L | 0.6 | 0.2 | 3.0 | 0.2 |
| | Degree of Hollowness (%) | 24 | 0 | 45 | 2 |
| | Number of Segments with radius of curvature p < r | 3 | — | 3 | 1 |
| Physical Properties of Non-woven Fabrics, Split ratio | Split ratio (%) | 80 | 40 | — | 45 |
| | Uniformity | O | x | — | x |
| | Mean Single Fiber Fineness of Split Fine Fibers (dtex/f) | 0.17 | 0.13 | — | 0.13 |
| | Strength at break (N/5 cm) | 90 | 45 | — | 70 |

As is obvious from the data in Table 4 and Table 5, the non-woven fabrics obtained in Examples 25 to 34 all ensured higher fiber split than those of Comparative Examples 9 and 11 when processed under the same condition. This means that the non-woven fabrics of the invention do not require treating with severe high-pressure liquid jets for splitting the constituent fibers into fine fibers. Therefore, according to the technique of the invention, even non-woven fabrics having a relatively low. Metsuke (weight) can be well produced and the uniformity of such non-woven fabrics produced in the invention is disordered little, and in addition, the cost for the treatment with high-pressure liquid jets can be significantly reduced.

Example 35

A high-melting-point resin, polypropylene (propylene homopolymer having a melting point of 163° C. and MFR of 16 g/10 min), and a low-melting-point resin, high-density polyethylene (having a melting point of 131° C. and MFR of 16 g/10 min) were used for the components (A) and (B) respectively. The two resins, components (A) and (B) were spun in a ratio by volume of 50/50 through a multi-component spinneret into splittable multi-component fibers having a single fiber fineness of 7.5 dtex. The non-drawn fibers were drawn to a drawing of 4.3 times at 90° C., and then passed between a pair of metal rolls both having a flat surface, under a pressure of 5 kg/cm. A dispersant serving as a wet-laying aid was applied thereto, and the fibers were cut into short fibers having a length of 5 mm. Having been thus processed, the fibers were deformed and flattened as in FIGS. 21 to 26 indicating the cross sections of the fibers. As illustrated, the contact interfaces of the constituent segments of the components (A) and (B) (represented by the white area and the black area in the figures—the same shall apply hereinunder) partly peeled off. The water content of the fibers was 20% by weight.

To the short fibers, added were 20% by weight of core/sheath bi-component fibers of polypropylene (core)/low-density polyethylene (sheath) (EAC fibers of 2.2 dtex×5 mm, from Chisso). The fiber blend was formed into webs according to a wet-laying process, for which was used a square wet-laying machine (25 cm×25 cm). Using a Yankee drier (from Kumagai Riki Kogyo), each web was dried at 105° C. for 3 minutes for pre-bonding it. The webs were exposed to high-pressure liquid jets in the manner mentioned above, and then dried in a drier at 80° C. to be fibrous articles. These comprised fine fibers split from the multi-component fibers and had a Metsuke (unit weight) of 55 g/m$^2$.

Example 36

In the same manner as in Example 35, produced were fibrous articles comprising fine fibers split from multi-component fibers and having a Metsuke (weight) of 50 g/m$^2$, for which, however, the pressure between the pair of metal rolls used was 20 kg/cm and not 5 kg/cm.

Example 37

A high-melting-point resin, polypropylene (propylene homopolymer having!a melting point of 163° C. and MFR of 20 g/10 min), and a low-melting-point resin, high-density polyethylene (having a melting point of 131° C. and MFR of 26 g/10 min) were used for the components (A) and (B), respectively. The two resins, components (A) and (B) were spun in a ratio by volume of 50/50 through a multi-component spinneret into splittable multi-component fibers having a single fiber fineness of 7.5 dtex. The non-drawn fibers were drawn to a drawing of 4.0 times at 90° C., and then passed between a pair of metal rolls both having a flat surface, under a pressure of 10 kg/cm. A dispersant serving as a wet-laying aid was applied thereto, and the fibers were cut into short fibers having a length of 5 mm. Having been thus processed, the fibers were deformed and flattened as in FIGS. 21 to 26 indicating the cross sections of the fibers. As illustrated, the contact interfaces of the constituent segments of the components (A) and (B) partly peeled off. The water content of the fibers was 20% by weight. To the short fibers, added were 20% by weight of core/sheath bi-component fibers of polypropylene (core)/low-density polyethylene (sheath) (EAC fibers of 2.2 dtex×5 mm, from Chisso). The fiber blend was formed into webs according to a wet-laying process, for which was used a square wet-laying machine (25 cm×25 cm). Using a Yankee drier (from Kumagai Riki Kogyo), each web was dried at 105° C. for 3 minutes for pre-bonding it. The webs were exposed to high-pressure liquid jets in the manner mentioned above, and then dried in a drier at 80° C. to be fibrous articles. These comprised fine fibers split from the multi-component fibers and had a Metsuke (weight) of 60 g/m$^2$.

Example 38

A high-melting-point resin, polypropylene (propylene homopolymer having a melting point of 163° C. and MFR of 16), and a low-melting-point resin, high-density polyethylene (having a melting point of 131° C. and MFR of 16 g/10 min) were used for the components (A) and (B), respectively. The two resins, components (A) and (B) were spun in a ratio by volume of 50/50 through a multi-component spinneret into splittable multi-component fibers having a single fiber fineness of 7.0 dtex. The non-drawn fibers were drawn to a drawing of 3.8 times at 90° C., and then passed between a pair of metal rolls both having a flat surface, under a pressure of 35 kg/cm. A dispersant serving as a wet-laying aid was applied thereto, and the fibers were cut into short fibers having a length of 5 mm. Having been thus processed, the fibers were deformed and flattened as in FIGS. 21 to 26 indicating the cross-section of the fibers. As illustrated, the contact interfaces of the constituent segments of the components (A) and (B) partly peeled off.

To the short fibers; added were 20% by weight of core/sheath bi-component fibers of polypropylene (core)/low-density polyethylene (sheath) (EAC fibers of 2.2 dtex×5 mm, from Chisso). The fiber blend was formed into webs according to a wet-laying process, for which was used a square wet-laying machine (25 cm×25 cm). Using a Yankee drier (from Kumagai Riki Kogyo), each web was dried at 105° C. for 3 minutes for pre-bonding it. The webs were exposed to high-pressure liquid jets in the manner mentioned above, and then dried in a drier at 80° C. to be fibrous articles. These comprised fine fibers split from the multi-component fibers and had a Metsuke (weight) of 55 g/m$^2$.

Example 39

A high-melting-point resin, polypropylene (propylene homopolymer having a melting point of 163° C. and MFR of 35 g/10 min), and a low-melting-point resin, linear low-density polyethylene (having a melting point of 131° C. and MFR of 26 g/10 min) were used for the components (A) and (B) respectively. The two resins, components (A) and (B) were spun in a ratio by volume of 50/50 through a multi-component spinneret into splittable multi-component fibers having a single fiber fineness of 8.0 dtex. The non-drawn fibers were drawn to a drawing of 4.5 times at 90° C., and then passed between a pair of metal rolls both having a flat surface, under a pressure of 5 kg/cm. A dispersant serving as a wet-laying aid was applied thereto, and the fibers were cut into short fibers having a length of 5 mm. Having been thus processed, the fibers were deformed and flattened as in FIGS. 21 to 26 indicating the cross sections of the fibers. As illustrated, the contact interfaces of the constituent segments of the components (A) and (B) partly peeled off. The water content of the fibers was 20% by weight.

To the short fibers, added were 20% by weight of core/sheath bi-component fibers of polypropylene (core)/low-density polyethylene (sheath) (EAC fibers of 2.2 dtex×5 mm, from Chisso Corporation). The fiber blend was formed into webs according to a wet-laying process, for which was used a square wet-laying machine (25 cm×25 cm). Using a Yankee drier (from Kumagai Riki Kogyo), each web was dried at 105° C. for 3 minutes for pre-bonding it. The webs were exposed to high-pressure liquid jets in the manner mentioned above, and then dried in a drier at 80° C. to be fibrous articles. These comprised fine fibers split from the multi-component fibers and had a Metsuke (weight) of 50 g/m$^2$.

Example 40

A high-melting-point resin, polypropylene (propylene homopolymer having a melting point of 163° C. and MFR of 16 g/10 min), and a low-melting-point resin, linear low-density polyethylene (having a melting point of 123° C. and MFR of 20 g/10 min) were used for the components (A) and (B), respectively. The two resins, components (A) and (B) were spun in a ratio by volume of 50/50 through a multi-component spinneret into splittable multi-component fibers having a single fiber fineness of 7.0 dtex. The non-drawn fibers were drawn to a drawing of 3.7 times at 90° C., and then passed between a pair of metal rolls both having a flat surface, under a pressure of 5 kg/cm. A dispersant serving as a wet-laying aid was applied thereto, and the fibers were cut into short fibers having a length of 5 mm. Having been thus processed, the fibers were deformed and flattened as in FIGS. 21 to 26 indicating the cross sections of the fibers. As illustrated, the contact interfaces of the constituent segments of the components (A) and (B) partly peeled off. The water content of the fibers was 20% by weight.

To the short fibers, added were 20% by weight of core/sheath bi-component fibers of polypropylene (core)/low-density polyethylene (sheath) (EAC fibers of 2.2 dtex×5 mm, from Chisso). The fiber blend was formed into webs according to a wet-laying process, for which was used a square wet-laying machine (25 cm×25 cm). Using a Yankee drier (from Kumagai Riki Kogyo), each web was dried at 105° C. for 3 minutes for pre-bonding it. The webs were exposed to high-pressure liquid jets in the manner mentioned above, and then dried in a drier at 80° C. to be fibrous articles. These comprised fine fibers split from the multi-component fibers and had a Metsuke (unit weight) of 50 g/m$^2$.

Example 41

In the same manner as in Example 35, prepared were splittable multi-component fibers having a Metsuke (weight) of 60 g/m$^2$, which, however, differ from those in Example 35 in that their cross section is essentially as in FIG. 27. The fibers were formed into fibrous articles like in Example 35.

Example 42

A high-melting-point resin, polypropylene (propylene homopolymer having a melting point of 163° C. and MFR of 16 g/10 min), and a low-melting-point resin, high-density polyethylene (having a melting point of 131° C. and MFR of 16 g/10 min) were used for the components (A) and (B), respectively. The two resins, components (A) and (B) were spun in a ratio by volume of 50/50 through a multi-component spinneret into splittable multi-component fibers having a single fiber fineness of 7.5 dtex. In the take-up step, sodium alkylphosphate was applied to the fibers. The non-drawn fibers were drawn to a drawing of 4.3 times at 90° C., then mechanically crimped with a crimper roll under a pressure of 3 kg/cm in a mechanical crimping device, and thereafter cut into short fibers having a length of 51 mm. Having been thus processed, the fibers were deformed and flattened as in FIGS. 21 to 26 indicating the cross sections of the fibers. As illustrated, the contact interfaces of the constituent segments of the components (A) and (B) partly peeled off.

The short fibers were formed into webs, using a roller carding machine. The webs were exposed to high-pressure liquid jets in the, manner as above, and then dried in a drier at 80° C. The fibrous articles thus produced comprised fine fibers split from the multi-component fibers, and had a Metsuke (unit weight) of 50 g/m$^2$. In these, the split ratio was 10%. While the webs were passed through the roller carding machine, the fiber segments constituting them were not too much split, and the processed webs had uniformity.

Example 43

A high-melting-point resin, polypropylene (propylene homopolymer having a melting point of 163° C. and MFR of 20 g/10 min), and a low-melting-point resin, high-density polyethylene (having a melting point of 131° C. and MFR of 20 g/10 min) were used for the components (A) and (B), respectively. The two resins, components (A) and (B) were spun in a ratio by volume of 50/50 through a multi-component spinneret into splittable multi-component fibers having a degree of hollowness of 10%, according to a spun-bonding method. The fibers having been jetted out of the spinneret were led into an air sucker and drawn therein under suction to be long multi-component fibers having a single fiber fineness of 2.0 dtex. Next, the long fibers thus having been led out of the air sucker were statically charged in a static charging device, and then dashed against a reflector plate to be opened. The thus-opened long fibers were collected to be a long fiber web on an endless mesh conveyor belt provided with a suction device on its back side. The long fiber web was pressed against a metal roll having a flat surface under a pressure of 10 kg/cm, and then embossed with an embossing roll having an area ratio of 15% and heated at 120° C. The thus-processed web was exposed to high-pressure liquid jets in the manner as above, and then dried in a drier at 80° C. to be a fibrous article having a Metsuke (weight) of 50 g/m$^2$. The web prepared herein comprised splittable multi-component fibers having cross sections of FIGS. 21 to 26.

Example 44

A high-melting-point resin, polypropylene (propylene homopolymer having a melting point of 163° C. and MFR of 16 g/10 min), and a low-melting-point resin, high-density polyethylene (having a melting point of 131° C. and MFR of 16 g/10 min), to which 0.4% by weight of a foaming agent (Dieblow HC from DAINICHISEIKA COLOR & CHEMICALS MFG.CO., LTD.) had been added, were used for the components (A) and (B), respectively. The two resins, components (A) and (B) were spun in a ratio by volume of 50/50 through a multi-component spinneret into splittable multi-component fibers having a single fiber fineness of 7.5 dtex. The non-drawn fibers were drawn to a drawing of 4.0 times at 90° C., and then passed between a pair of metal rolls both having a flat surface, under a pressure of 5 kg/cm. A dispersant serving as a wet-laying aid was applied thereto, and the fibers were cut into short fibers having a length of 5 mm. Having been thus processed, the fibers were deformed and flattened as in FIGS. 21 to 26 indicating the cross sections of the fibers. As illustrated, the contact interfaces of the constituent segments of the components (A) and (B) partly peeled off, and the segments contained bubbles. The water content of the fibers was 20% by weight.

To the short fibers, added were 20% by weight of core/sheath bi-component fibers of polypropylene (core)/low-density polyethylene (sheath) (EAC fibers of 2.2 dtex×5 mm, from Chisso). The fiber blend was formed into webs according to a wet-laying process, for which was used a square wet-laying machine (25 cm×25 cm). Using a Yankee drier (from Kumagai Riki Kogyo), each web was dried at 105° C. for 3 minutes for pre-bonding it. The webs were exposed to high-pressure liquid jets in the manner mentioned above, and then dried in a drier at 80° C. to be fibrous articles. These comprised fine fibers split from the multi-component fibers and had a Metsuke (unit weight) of 55 g/m$^2$.

Examples 45, 46

Using a roller carding machine, the splittable multi-component fibers of the invention prepared in Example 42 were formed into webs (C) having a Metsuke (unit weight) of 10 g/m$^2$. On the other hand, short, core/sheath bi-component fibers of polypropylene (core) /high-density polyethylene (sheath) (ESC fibers from Chisso Corporation, 2.2 dtex×51 mm) were formed into card webs (D) having a Metsuke (weight) of 10 g/m$^2$, also using a roller carding machine. The webs C and D were laminated to form a C/D laminate (Example 45), and a C/D/C laminate (Example 46). These laminates were exposed to high-pressure liquid jets in the manner as above, and then dried in a drier at 80° C. to be laminated fibrous articles. These laminated fibrous articles were tried as wipers, and were all very good.

Example 47

A high-melting-point resin, polypropylene (propylene homopolymer having a melting point of 163° C. and MFR of 20 g/10 min), and a low-melting-point resin, high-density polyethylene (having a melting point of 131° C. and MFR of 20 g/10 min) were used for the components (A) and (B), respectively. The two resins, components (A) and (B) were spun in a ratio by volume of 50/50 through a multi-component spinneret into splittable multi-component fibers having a degree of hollowness of 10%, according to a spun-bonding method. The fibers having been jetted out of the spinneret were led into an air sucker and drawn therein under suction to be long multi-component fibers having a single fiber fineness of 2.0 dtex. Next, the long fibers thus having been led out of the air sucker were statically charged in a static charging device, and then dashed against a reflector plate to be opened. The thus-opened long fibers were collected to be a long fiber web on an endless mesh conveyor belt provided with a suction device on its back side. The web had a Metsuke (weight) of 10 g/m$^2$, and this is for an interlayer of laminated fibrous articles.

On the other hand, the polypropylene resin (A) (propylene homopolymer having a melting point of 163° C. and MFR of 20 g/10 min) and the high-density polyethylene resin (B) (having a melting point of 131° C. and MFR of 20 g/10 min) were spun in a ratio by volume of 50/50 into core/sheath multi-component fibers of A (core) /B (sheath) having a single fiber fineness of 2.0 dtex, also according to a spun-bonding method. The spun-bonded web thus prepared had a Metsuke (weight) of 5.0 g/m$^2$, and this is for upper and lower layers of laminated fibrous articles. These webs were laminated, with the interlayer web being sandwiched between the upper and lower webs.

The resulting fibrous laminate was pressed at 20 kg/cm against a metal roll having a flat surface, whereby the splittable multi-component fibers constituting the interlayer were deformed to have flattened cross sections as in FIGS. 21 to 26. This was then embossed with an embossing roll having an area ratio of 15% and heated at 120° C., then exposed to high-pressure liquid jets in the manner as above, and dried in a drier at 80° C. to be a fibrous article of the invention comprising fine fibers split from the multi-component fibers. This was used for the top sheet of diapers for adults. The top sheet had good water pressure resistance and high mechanical strength. The fibrous article produced herein is extremely favorable for absorbent articles.

Comparative Example 12

In the same manner as in Example 35, prepared were splittable multi-component fibers having a Metsuke (weight)

of 55 g/m$^2$. In this, however, the drawn fibers were not passed between a pair of pressure metal rolls, and therefore their cross section was as in FIG. 33. The multi-component fibers were formed into fibrous articles like in Example 35.

Comparative Example 13

In the same manner as in Example 40, prepared were splittable multi-component fibers having a Metsuke (weight) of 50 g/m$^2$. In this, however, the drawn fibers were not passed between a pair of pressure metal rolls, and therefore their cross section was as in FIG. 33. The multi-component fibers were formed into fibrous articles like in Example 40.

Comparative Example 14

In the same manner as in Example 42, prepared were splittable multi-component fibers having a Metsuke (weight) of 50 g/m$^2$. In this, however, the drawn fibers were not passed between a pair of pressure metal rolls, and therefore their cross section was as in FIG. 33. The multi-component fibers were formed into fibrous articles like in Example 42.

The spinning and drawing condition for the fibers of Examples 35 to 44. and Comparative Examples 12 to 14, the physical properties of the fibers, the profile of the fibers, the physical properties of the non-woven fabrics comprising the fibers, and the split ratio in the non-woven fabrics are given in Tables 6 and 7.

INDUSTRIAL APPLICABILITY

In the splittable multi-component fiber of the first aspect of the invention, the segments of one thermoplastic resin component are partly broken or foamed to form a completely-conjugated part, and a partially-conjugated part and/or a non-conjugated part, thereby forming random discontinuous deletions. The fiber is so constituted that it well receives physical stress of needle punching or high-pressure water jets concentrated to the deletions. The energy to be applied to the fiber for splitting it into fine fibers may be small. Even when the fiber is composed of a plurality of components that are well miscible with each other, for example a plurality of polyolefin resin components, it may be readily split into fine fibers by low energy applied thereto. The energy cost for splitting the fiber may be reduced. Non-woven fabrics having a good uniformity can be readily made from the fibers.

The splittable multi-component fiber of the second aspect of the invention also has the advantage of easy splittability. Not requiring any specific additive for facilitating its split, the fiber can be readily split into fine fibers. For splitting the fiber, high physical impact is not needed. Fibrous articles and laminated fibrous articles comprising the fibers have a tight and good uniformity, and their production from the fibers is easy.

The splittable polyolefinic multi-component fiber of the third aspect of the invention also has the advantage of easy

TABLE 6

| | Example 35 | Example 36 | Example 37 | Example 38 | Example 39 | Example 40 | Example 41 |
|---|---|---|---|---|---|---|---|
| Production Condition | | | | | | | |
| Hollowness before roll pressure (%) | 20 | 20 | 5 | 35 | 20 | 20 | 20 |
| Roll Pressure (kg/cm) | 5 | 20 | 10 | 35 | 5 | 5 | 5 |
| Physical Properties of Fibers | | | | | | | |
| Fineness of Drawn Fibers (dtex/f) | 2.0 | 2.0 | 3.0 | 3.0 | 2.0 | 2.0 | 2.0 |
| Strength at break (cN/dtex) | 4.0 | 4.0 | 3.7 | 3.1 | 3.2 | 3.2 | 4.2 |
| Elongation (%) | 45 | 43 | 58 | 40 | 36 | 50 | 49 |
| Multi-component Profile of Fibers | | | | | | | |
| Degree of Deformation | 0.6 | 0.5 | 0.9 | 0.15 | 0.85 | 0.6 | 0.70 |
| Percentage of Peeling (%) | 10 | 12 | 5 | 17 | 8 | 10 | 10 |
| Fiber Split | | | | | | | |
| Split ratio (%) | 75 | 80 | 65 | 80 | 65 | 70 | 75 |
| Uniformity | ○ | ○ | ○ | ○ | ○ | ○ | ○ |

TABLE 7

| | Example 42 | Example 43 | Example 44 | Comp. Ex. 12 | Comp. Ex. 13 | Comp. Ex. 14 |
|---|---|---|---|---|---|---|
| Production Condition | | | | | | |
| Hollowness before roll pressure (%) | 20 | 10 | 25 | 20 | 20 | 10 |
| Roll Pressure (kg/cm) | 5 | 10 | 5 | 0 | 0 | 0 |
| Physical Properties of Fibers | | | | | | |
| Fineness of Drawn Fibers (dtex/f) | 2.0 | 2.0 | 3.0 | 2.0 | 2.0 | 2.0 |
| Strength at break (cN/dtex) | 4.0 | 1.5 | 2.8 | 4.0 | 3.5 | 1.5 |
| Elongation (%) | 45 | 320 | 25 | 45 | 40 | 340 |
| Multi-component Profile of Fibers | | | | | | |
| Degree of Deformation | 0.6 | 0.65 | 0.5 | 0.95 | 0.95 | 0.95 |
| Percentage of Peeling (%) | 12 | 12 | 15 | 0 | 0 | 0 |
| Fiber Split | | | | | | |
| Split ratio (%) | 90 | 60 | 80 | 40 | 45 | 35 |
| Uniformity | ○ | ○ | ○ | Δ | Δ | Δ |

splittability. Not requiring any specific additive for facilitating its split, the fiber can be readily split into fine fibers. For splitting the fiber, high physical impact is not needed. Fibrous articles comprising the fibers have a tight and good uniformity, and their production from the fibers is easy.

The splittable multi-component fiber of the fourth aspect of the invention also has the advantage of easy splittability. Not requiring any specific additive for facilitating its split, the fiber can be readily split into fine fibers. For splitting the fiber, high physical impact is not needed. Fibrous articles and laminated fibrous articles comprising the fibers have a tight and good uniformity, and their production from the fibers is easy.

Accordingly, non-woven fabrics made from the splittable multi-component fibers of the first to fourth aspects of the invention are favorable for medical and industrial wiping cloths, masks, operating gowns, filtration cloths, filters, top sheets for sanitary articles, etc. In particular, the non-woven fabrics of the fibers in which both the thermoplastic resin components (A) and (B) are polyolefin resins have higher acid resistance and alkali resistance than those of conventional, splittable polyolefinic multi-component fibers, and they are favorable for industrial materials and sanitary materials, for example, for battery separators, wipers, etc.

What is claimed is:

1. A splittable polyolefin multi-component fiber comprising at least two polyolefin resin components and having a hollow in its center, which is characterized in that the individual constituent components are alternately radially aligned around the hollow in-its cross section, the percentage of its hollowness falls between 5 and 40%, and the ratio of the mean length, W, of the outer peripheral arc of one constituent resin component to-the mean thickness, L, of the component between the end of the hollow and the outer periphery of the fiber, W/L, falls between 0.25 and 2.5.

2. The splittable polyolefin multi-component fiber as claimed in claim 1, wherein the cross-section profile of the hollow is so configured that it has at least one curve of which the radius of curvature (ρ) is smaller than the radius of the circle having the same area as the cross-sectional area of the hollow.

3. The splittable polyolefin multi-component fiber as claimed in claim 1, wherein at least two constituent polyolefin resin components all have, after having formed fibers, a melt flow rate falling between 10 and 100 g/10 min, and the ratio of the melt flow rate, MFR-A, of the resin component (component A) having the highest melting point of all the constituent components to the melt flow rate, MFR-B, of the resin component (component B) having the lowest melting point of all, MFR-A/MFR-B falls between 0.1 and 5.

4. The splittable polyolefin multi-component fiber as claimed in claim 1, wherein the combination of at least two polyolefin resin components is a combination of a polypropylene resin and a polyethylene resin.

5. The splittable polyolefin multi-component fiber as claimed in claim 1, wherein the combination of at least two polyolefin resin components is a combination of a stereospecific polystyrene resin and a polypropylene resin.

6. The splittable polyolefin multi-component fiber as claimed in claim 1, which has, before being split, a single fiber fineness falling between 0.6 and 10 dtex, and gives, after having been split, fine fibers having a single fiber fineness of smaller than 0.6 dtex.

* * * * *